US010232492B2

(12) United States Patent
Arvinte et al.

(10) Patent No.: US 10,232,492 B2
(45) Date of Patent: Mar. 19, 2019

(54) SANDING DEVICE, AND SANDING ASSEMBLY INCLUDING THE SAME

(71) Applicant: A. Richard Tools Co./ Outils A. Richard Co., Berthierville (CA)

(72) Inventors: Roméo Arvinte, Laval-des-Rapides (CA); François Panfili, Berthierville (CA)

(73) Assignee: A. RICHARD TOOLS CO./OUTILS A. RICHARD CO., Berthierville, Quebec (CA)

( * ) Notice: Subject to any disclaimer, the term of this patent is extended or adjusted under 35 U.S.C. 154(b) by 0 days.

(21) Appl. No.: 14/909,422

(22) PCT Filed: May 5, 2014

(86) PCT No.: PCT/CA2014/050427

§ 371 (c)(1),
(2) Date: Feb. 1, 2016

(87) PCT Pub. No.: WO2015/013810

PCT Pub. Date: Feb. 5, 2015

(65) Prior Publication Data

US 2016/0167199 A1 Jun. 16, 2016

Related U.S. Application Data

(60) Provisional application No. 61/861,193, filed on Aug. 1, 2013.

(30) Foreign Application Priority Data

Aug. 1, 2013 (CA) ..... 2822631

(51) Int. Cl.
*B24D 15/02* (2006.01)
*B24D 15/04* (2006.01)

(52) U.S. Cl.
CPC ..... *B24D 15/023* (2013.01); *B24D 15/04* (2013.01)

(58) Field of Classification Search
CPC ..... B24D 15/023; B24D 15/04
USPC ..... 451/344
See application file for complete search history.

(56) References Cited

U.S. PATENT DOCUMENTS 3,160,995 A 12/1964 Danuski, Jr.
3,973,362 A * 8/1976 Groshans ..... B24D 15/023 451/344
4,062,152 A * 12/1977 Mehrer ..... B24B 55/06 451/344
D258,043 S 1/1981 Gregoire
(Continued)

FOREIGN PATENT DOCUMENTS

WO WO 2011051635 A1 * 5/2011 ..... B24D 15/023

OTHER PUBLICATIONS

International Search Report for corresponding International Patent Application No. PCT/CA2014/050427 dated Aug. 20, 2014.

*Primary Examiner* — George B Nguyen
(74) *Attorney, Agent, or Firm* — Merchant & Gould P.C.

(57) ABSTRACT

A sanding device (1) includes a base plate (3) with opposite sanding and supporting surfaces (5,7); as well as a joint (29) operatively mounted onto the supporting surface (7) of the base plate (3) and rotatable about a first axis of rotation (93). A supporting tube is (69) operatively mounted onto the joint (29) and rotatable with respect to the joint (29) about a second axis of rotation (95).

21 Claims, 31 Drawing Sheets

(56) References Cited

U.S. PATENT DOCUMENTS

D263,277 S 3/1982 Gregoire
4,320,601 A 3/1982 Haney
4,697,389 A 10/1987 Romine
4,757,572 A * 7/1988 Yon ..... E04F 21/1655 15/235.7
4,779,385 A 10/1988 Reiter
4,937,984 A 7/1990 Taranto
4,964,243 A * 10/1990 Reiter ..... B24D 15/023 451/354
5,007,206 A 4/1991 Paterson
5,036,627 A 8/1991 Walters
5,056,268 A 10/1991 Wolff
5,123,216 A 6/1992 Kloss et al.
5,179,807 A * 1/1993 Gupton ..... A47L 13/02 451/344
5,193,313 A * 3/1993 Sanchez ..... B24B 55/105 451/344
5,239,783 A 8/1993 Matechuk
5,245,797 A 9/1993 Milkie
D343,104 S 1/1994 Hoshino
D344,003 S 2/1994 Milkie
5,313,746 A 5/1994 Zarriello
5,319,889 A 6/1994 Rudolf et al.
D353,313 S 12/1994 Stiles
5,398,454 A 3/1995 Berner
5,398,457 A 3/1995 Updegrave et al.
D354,666 S 6/1995 Kriebel
5,428,865 A 7/1995 Yarbrough
5,470,272 A 11/1995 Kikuchi et al.
5,482,499 A 1/1996 Satoh
5,527,212 A 6/1996 Bowen et al.
D371,948 S 7/1996 Liu
5,533,925 A 7/1996 Sato
5,558,569 A 9/1996 Lee
5,605,500 A 2/1997 Matechuk
5,624,305 A * 4/1997 Brown ..... B24B 55/06 16/337
5,634,843 A * 6/1997 Liu ..... B24B 55/10 451/344
D387,962 S 12/1997 Apolinski et al.
5,709,595 A 1/1998 Bergner et al.
D392,860 S 3/1998 Brown
5,833,524 A 11/1998 Satoh et al.
D404,273 S 1/1999 Somers
5,902,176 A * 5/1999 Chen ..... B24B 23/04 451/517
D414,395 S 9/1999 Panfili
5,967,886 A 10/1999 Wuensch et al.
6,004,194 A 12/1999 Hild et al.
6,099,397 A 8/2000 Wurst
D431,993 S 10/2000 Panfili et al.
D435,408 S 12/2000 Panfili et al.
6,179,698 B1 1/2001 Duffy
6,257,969 B1 7/2001 Bosten et al.
6,347,985 B1 2/2002 Loveless
D459,965 S 7/2002 Pretzell
D463,639 S 9/2002 Panfili et al.
6,468,141 B1 * 10/2002 Conboy ..... B24B 7/18 451/344
D474,389 S 5/2003 Panfili et al.
6,629,331 B2 10/2003 Panfili et al.
6,659,852 B1 * 12/2003 Wettstein ..... B24B 7/18 451/344
6,705,931 B2 3/2004 Moolenaar et al.
6,719,620 B1 4/2004 Panfili et al.
6,726,868 B1 4/2004 Panfili et al.
6,742,215 B2 6/2004 Panfili et al.
D494,434 S 8/2004 Sun et al.
6,775,912 B2 8/2004 Panfili et al.
6,860,799 B2 3/2005 Loveless
D504,602 S 5/2005 Aglassinger et al.
D511,954 S 11/2005 Heun
6,991,529 B2 * 1/2006 Annis ..... A47L 13/24 451/28
7,014,546 B1 3/2006 Birk
7,033,259 B1 4/2006 Seasholtz et al.
7,275,981 B1 * 10/2007 Hurt ..... B24D 15/023 451/524
7,384,328 B2 * 6/2008 Panfili ..... B24B 23/00 451/344
D652,283 S 1/2012 Arvinte et al.
8,157,622 B2 * 4/2012 Ali ..... B24D 15/04 451/344
2001/0051501 A1 12/2001 Pellegrin
2004/0192180 A1 9/2004 Bosten et al.
2005/0287937 A1 12/2005 Florio
2007/0135029 A1 * 6/2007 Field ..... B24D 15/04 451/344
2008/0109975 A1 * 5/2008 Park ..... A47L 1/08 15/105
2009/0004955 A1 * 1/2009 Gringer ..... B24D 15/04 451/344

* cited by examiner

Assembly view

Head Assembly view

Head Assembly view

09 Body Shell
General Dimensional Tolerances
+ 0.1 mm
- 0.1 mm

RVPS 05 Living Hinge Joint Connector
Polypropylene

RVPS 05 Living Hinge Joint Connector
Polypropylene

111 Core Pivot
Machined from a Delrin round bar
General Dimensional Tolerance
+ 0.1 mm
- 0.1 mm

111 Core Pivot
Machined from a Delrin round bar

093 Blade
General Dimensional Tolerances
+ 0.1 mm
- 0.1 mm

094 Thumb Nut
General Dimensional Tolerances
+ 0.1 mm
- 0.1 mm

SANDING DEVICE, AND SANDING ASSEMBLY INCLUDING THE SAME

This application is a National Stage Application of PCT/CA2014/050427, filed 5 May 2014, which claims benefit of Ser. No. 61/861,193, filed 1 Aug. 2013 in the U.S. and Serial No. 2822631, filed 1 Aug. 2013 in Canada and which applications are incorporated herein by reference. To the extent appropriate, a claim of priority is made to each of the above disclosed applications.

FIELD OF THE INVENTION

The present invention relates to a sanding device, hereinafter referred to also as a "sanding tool". More particularly, in its preferred intended use, the present invention relates to a sanding tool such as the ones used with extensions poles, vacuum systems and the like, and also relates to a vacuum/sanding assembly provided with such a sanding tool, and to a method of operating associated thereto.

BACKGROUND OF THE INVENTION

Known in the art are various tools used for sanding applications and other related tasks.

The Assignee of the present application has developed several of such products, some of which are described in the following U.S. Pat. and industrial designs: D258,043; D263,277; D414,395; D431,993; D435,408; D463,639; D474,389; U.S. Pat. Nos. 6,629,331; 6,719,620; 6,726,868; 6,742,215; 6,775,912; and 7,384,328; the contents of which are incorporated here by reference.

Also known to the Applicant are the following US patents, patent application and industrial designs which describe sanding tools and the like: U.S. Pat. Nos. 3,160,995; 4,062,152; 4,320,601; 4,779,385; 4,937,984; 4,964,243; 5,007,206; 5,036,627; 5,056,268; 5,123,216; 5,193,313; 5,527,212; 5,239,783; 5,245,797; 5,313,746; 5,319,889; 5,398,454; 5,398,457; 5,470,272; 5,482,499; 5,533,925; 5,558,569; 5,605,500; 5,624,305; 5,709,595; 5,833,524; 5,967,886; 6,004,194; 6,099,397; 6,179,696 B1; 6,257,969 B1; 6,705,931 B2; 6,860,799 B2; 7,033,259 B1; D343,104; D344,003; D354,666; D371,948; D387,962; D392,860; D404,273; D459,965 S; D494,434 S; D504,602 S; D511,954 S; 2001/0051501 A1; and 2004/0192180 A1.

Indeed, sanding tools are very well known in the art. A typical sanding tool usually comprises a handle for manual operation of the tool and a working or operating surface onto which a sandpaper (or a sanding meshing) is mounted and rested so as to be able to carry out sanding applications by passing the sandpaper-covered operating surface over the area to be sanded.

Also known in the art are the fastening devices which are commonly used to removably mount a sandpaper onto such a sanding tool. Indeed, a typical fastening device generally consists of a pin projecting from a rear portion of the sanding tool onto which a clamping plate is pivotally mounted. A portion of the sandpaper is generally clamped between the rear portion and the clamping plate and this is generally achieved by urging the plate against the rear portion of the sanding tool by means of a nut threadedly engageable onto the pin and rotated thereabout so as to bias the clamping plate against the rear portion. The nut is usually provided with a pair of projections which are commonly known as "rabbit ears" and which are used to facilitate the rotation of the nut about the threaded pin with the fingers of an operator of the tool.

Furthermore, it is also known that most conventional sanding devices that are not used with vacuum systems do not enable a proper evacuation of sanded particulars from either the operating surface of the tool or from the surface being worked on by said tool, and that even some conventional sanding devices that are used with vacuum systems present significant shortcomings in terms of sanding results (ex. performance, efficiency, etc.) and in terms of suction and/or evacuation of sanded particles (ex. during use in hard-to-reach places, etc.), and in terms of maneuverability (range of motion, flexibility of sanding possibilities and angles, etc.).

Hence, in light of the aforementioned, there is a need for an improved sanding device which would be able to overcome and/or remedy some of the aforementioned prior art problems.

SUMMARY OF THE INVENTION

An object of the present invention is to provide a sanding device which, by virtue of its design and components, satisfies some of the above-mentioned needs and is thus an improvement over other related sanding devices and/or methods known in the prior art.

In accordance with the present invention, the above object is achieved, as will be easily understood from the present description, with a sanding device such as the one briefly described herein and such as the one exemplified in the accompanying drawings.

According to one aspect of the present invention, there is provided a sanding device comprising:

a base plate comprising opposite sanding and supporting surfaces;

a joint operatively mounted onto the supporting surface of the base plate and rotatable with respect to said base plate about a first axis of rotation; and a supporting tube operatively mounted onto the joint and rotatable with respect to said joint about a second axis of rotation.

According to a preferred embodiment of the present invention, the joint is an elongated joint, having a substantially tube-like configuration, rotatable about the first axis of rotation, and the joint also includes an upper longitudinal recess along which the supporting tube may be displaced and rotated about the second axis of rotation.

According to another aspect of the invention, there is also provided a sanding assembly for sanding and/or evacuating particles, the sanding assembly comprising the above-mentioned sanding device and/or at least one complementary accessory (ex. extension pole, vacuum system and/or hose thereof, etc.).

According to yet another aspect of the invention, there is also provided a method of operating the above-mentioned sanding device and/or sanding assembly.

According to yet another aspect of the invention, there is also provided a method of securing/mounting the above-mentioned sanding device onto a complementary accessory.

According to yet another aspect of the invention, there is also provided a kit with components for assembling the above-mentioned sanding device and/or sanding assembly.

According to yet another aspect of the present invention, there is also provided a set of components for interchanging with components of the above-mentioned kit.

According to yet another aspect of the present invention, there is also provided a method of assembling components of the above-mentioned kit and/or set.

According to yet another aspect of the present invention, there is also provided a method of doing business with the above-mentioned sanding device, sanding assembly, kit, set and/or method.

The objects, advantages, and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 1:
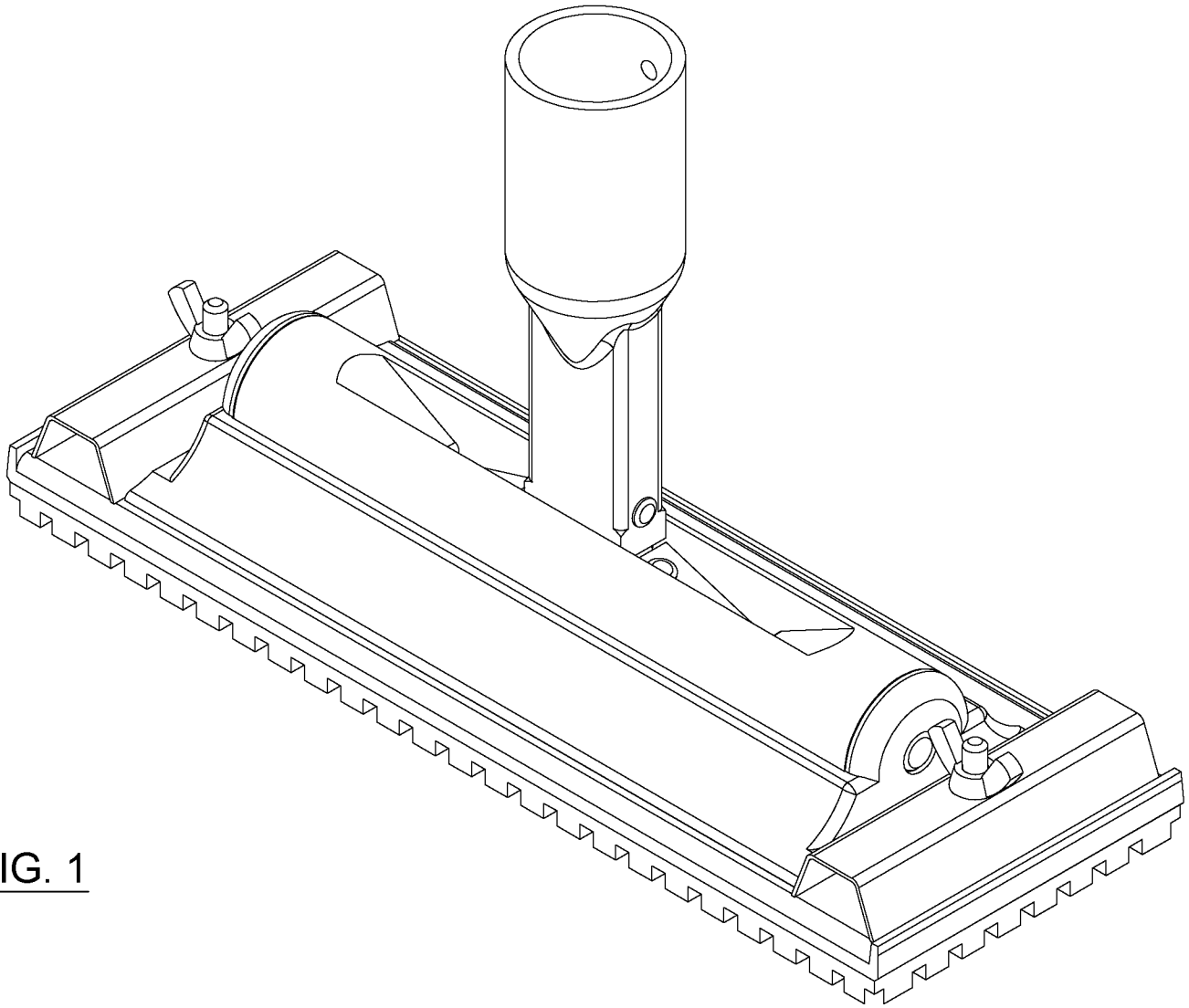
FIGS. 1-17 are different views of a sanding device according to a possible preferred embodiment of the present invention.
Figure 2:
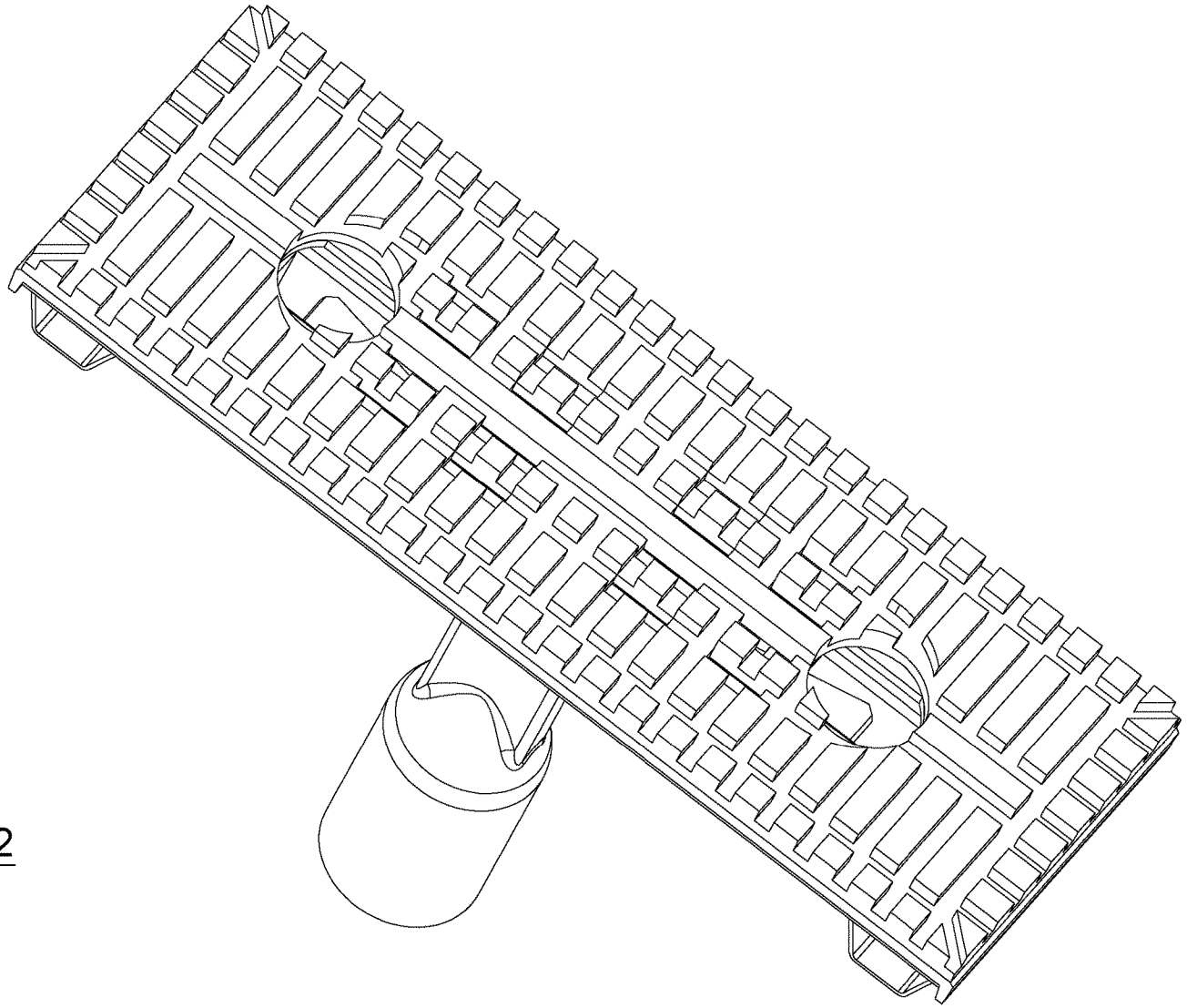
Figure 3:
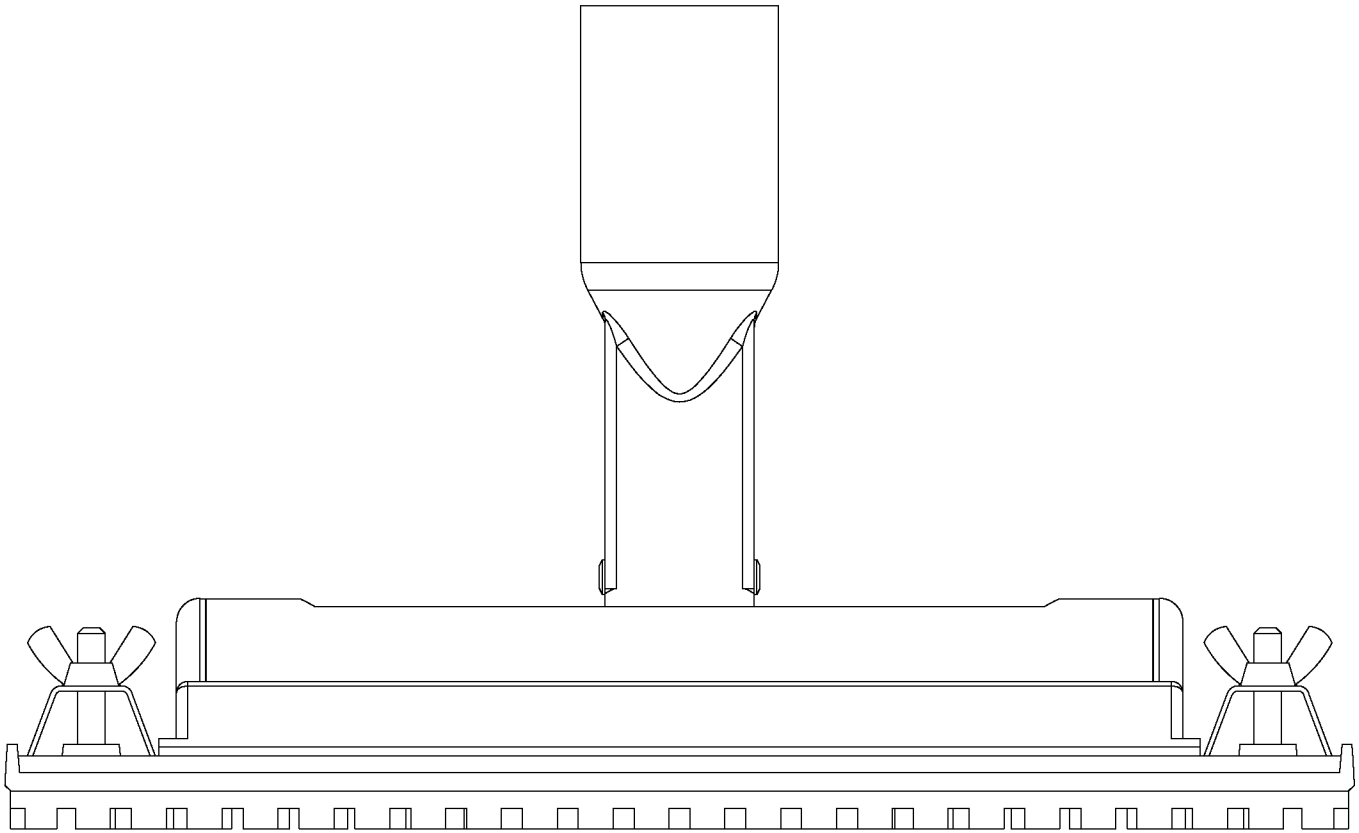
Figure 4:
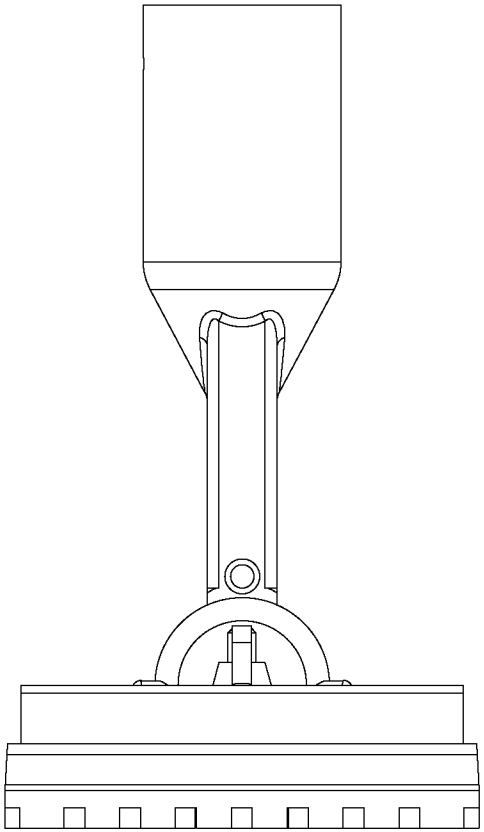
Figure 5:
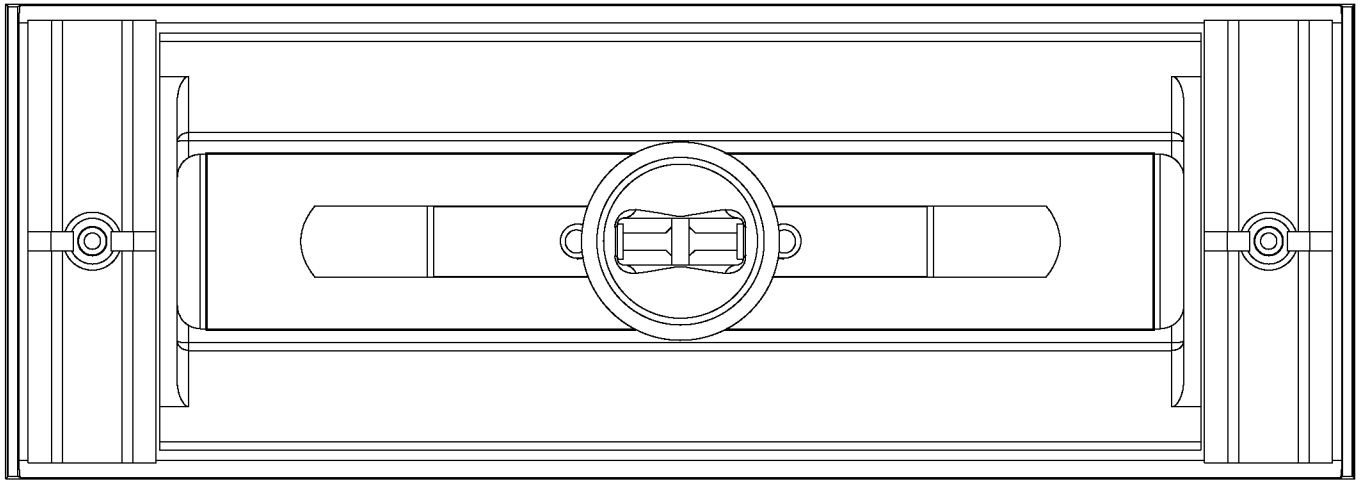
Figure 6:
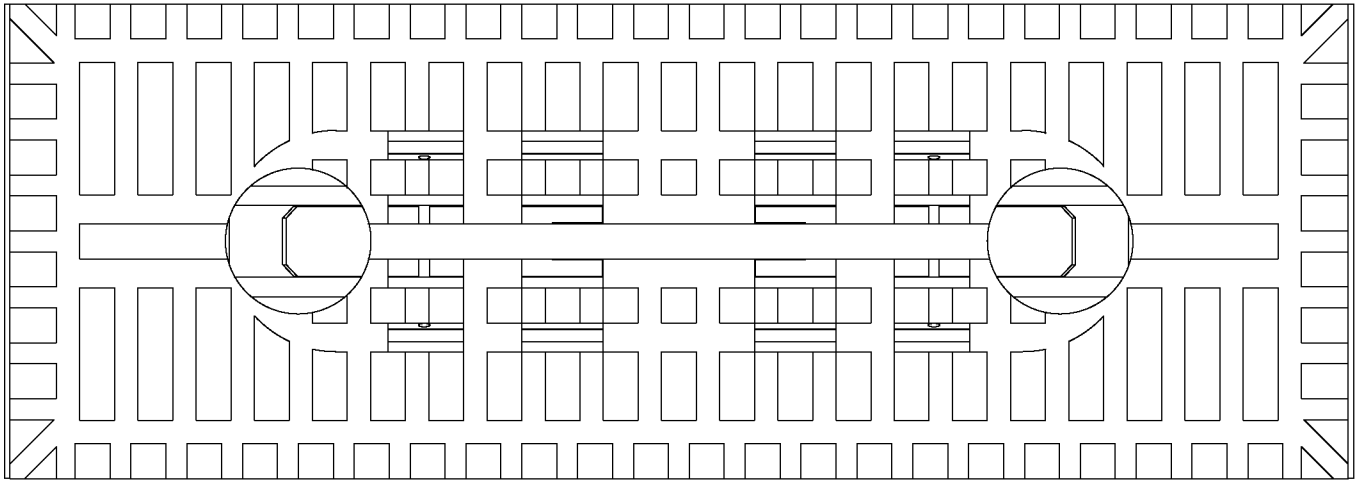
Figure 7:
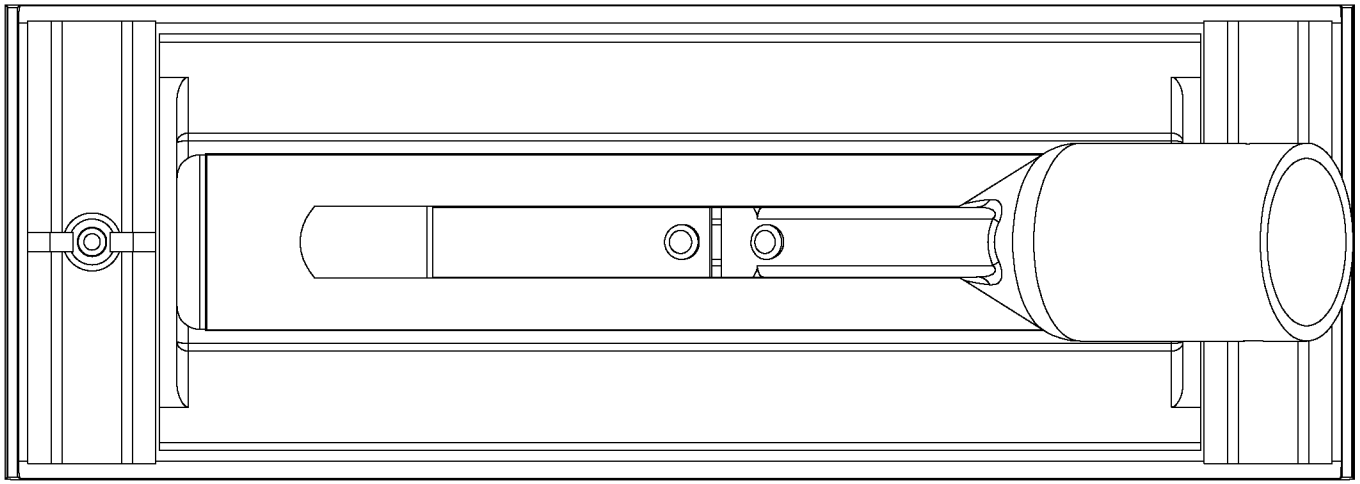
Figure 8:
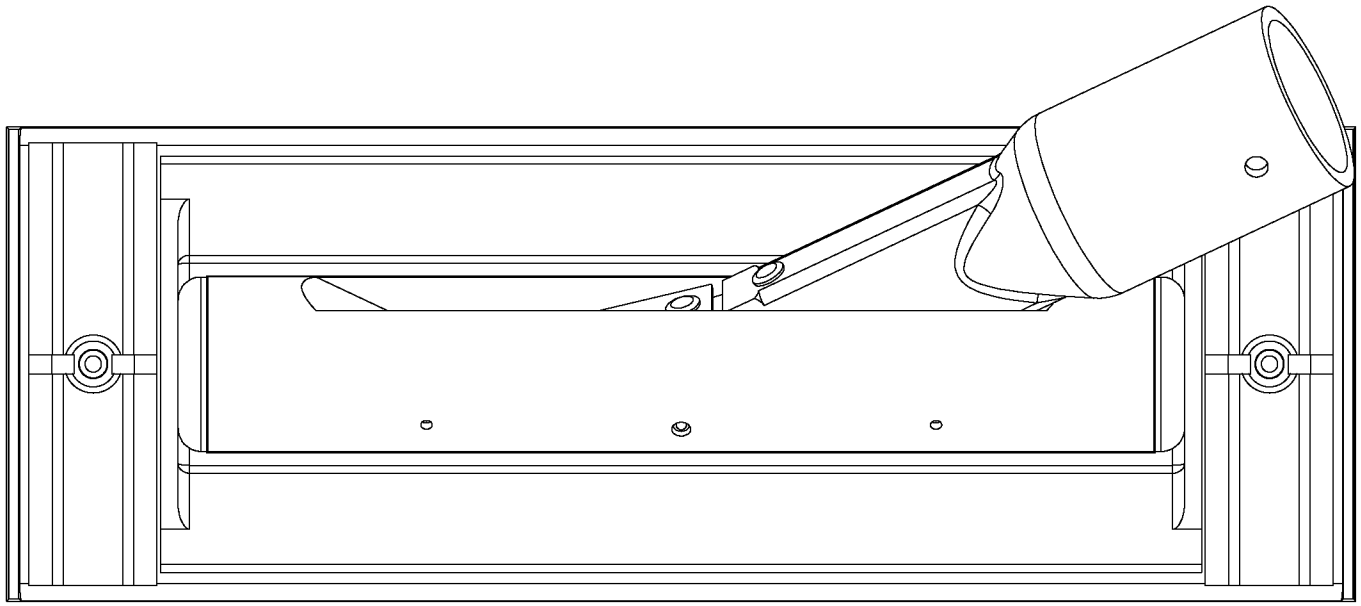
Figure 9:
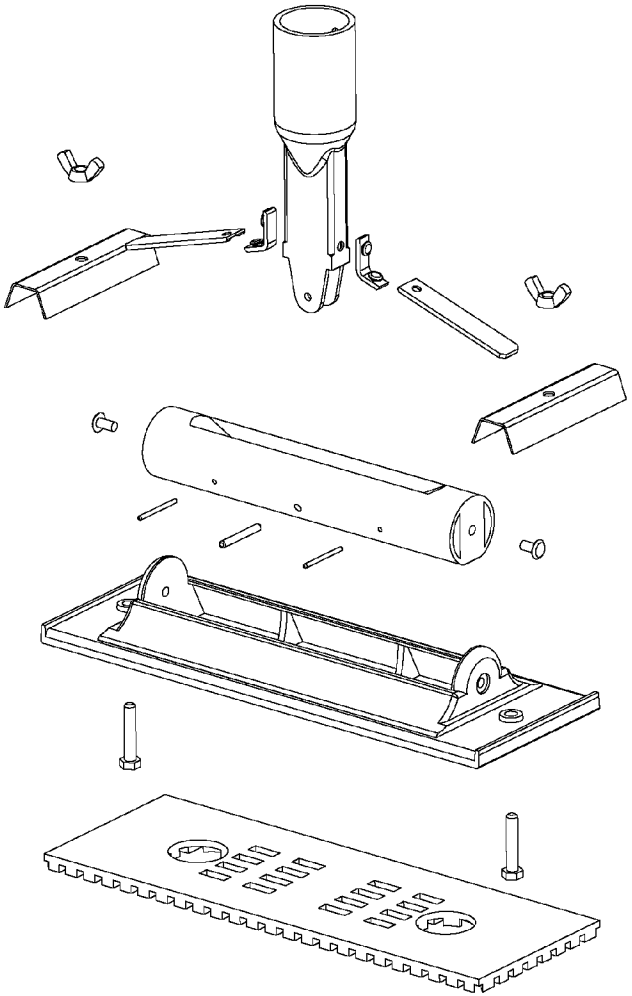

In the following description, the same numerical references refer to similar elements. Furthermore, for sake of simplicity and clarity, namely so as to not unduly burden the figures with several references numbers, only some figures have been provided with reference numbers, and components and features of the present invention illustrated in other figures can be easily inferred therefrom. The embodiments, geometrical configurations, materials mentioned and/or dimensions shown in the figures are preferred, for exemplification purposes only.

Moreover, although the present invention was primarily designed for use with a sanding paper/meshing for carrying out sanding applications, preferably in conjunction with an extension pole, a vacuum system and/or the like, it may be used with other objects and/or in other types of applications, as apparent to a person skilled in the art. For this reason, expressions such as "sanding", "paper", "meshing", "extension", "pole", "vacuum", etc., used herein should not be taken so as to limit the scope of the present invention and include all other kinds of objects and/or applications with which the present invention could be used and may be useful.

Moreover, in the context of the present invention, the expressions "tool", "device", "system", "sander", "unit", "assembly", "product", as well as any other equivalent expressions and/or compound words thereof, may be used interchangeably. The same applies for any other mutually equivalent expressions, such as "paper" and "meshing" for example, as well as "base", "plate" and "handle", or even "fastener" and "pin", as also apparent to a person skilled in the art.

Furthermore, in the context of the present description, it will be considered that all elongated objects will have an implicit "longitudinal axis" or "centerline", such as the longitudinal axis of a fastener or a tube (ex. joint), or the centerline of a bore, for example, and that expressions such as "connected" and "connectable", or "mounted" and "mountable", may be interchangeable, in that the present invention also relates to a kit with corresponding components for assembling a resulting fully assembled and operational sanding device (1).

In addition, although the preferred embodiments of the present invention as illustrated in the accompanying drawings comprise various components, and although the preferred embodiments of the sanding device (1) and corresponding parts as shown consist of certain geometrical configurations as explained and illustrated herein, not all of these components and geometries are essential to the invention and thus should not be taken in their restrictive sense, i.e. should not be taken so as to limit the scope of the present invention. It is to be understood, as also apparent to a person skilled in the art, that other suitable components and cooperation thereinbetween, as well as other suitable geometrical configurations may be used for the sanding device (1) and corresponding parts according to the present invention, as will be briefly explained herein and as can be easily inferred herefrom by a person skilled in the art, without departing from the scope of the present invention.

Broadly described, and as better exemplified in the accompanying drawings, the present invention relates to a sanding device (1) with improved shape, components and features enabling for better, easier and more convenient sanding applications.

LIST OF NUMERICAL REFERENCES FOR SOME OF THE CORRESPONDING POSSIBLE COMPONENTS ILLUSTRATED IN THE ACCOMPANYING DRAWINGS

1. sanding device
3. base plate (or "support plate")
3*a*. support plate (of base plate)
5. sanding surface (of base plate)
7. supporting surface (of base plate)
9. first flange (of base plate)
11. second flange (of base plate)
13. first rim (of base plate)
15. second rim (of base plate)
17. orifice (of base plate)
17*a*. sub-orifice (of base plate)
19. through-hole (of base plate)
21. fastening device (ex. for fastening a sanding paper/meshing)
23. clamping plate (of fastening device)
25. fastener (ex. bolt, pin, rivet, etc.) (of fastening device)
27. tightening component (ex. nut) (of fastening device)
29. joint
31. first mounting pin (of joint)
33. second mounting pin (of joint)
35. first end plate (of joint)
37. second end plate (of joint)
39. recess (of joint)
41. first shoulder (of joint)
43. second shoulder (of joint)
45. transversal bore hole(s) (of joint)
47. first supporting/guiding pin (of joint)
49. second supporting/guiding pin (of joint)
51. mounting pin (of joint, for mounting flanges of supporting tube)
53. first abutment section (of joint)
55. second abutment section (of joint)
57. first sealing member
59. second sealing member
61. first hinge
63. second hinge
65. male component (ex. on hinge)
67. female component (ex. on supporting tube or on sealing member)
69. supporting tube
71. first end (of supporting tube)
73. second end (of supporting tube)
75. first mounting flange (of supporting tube)

77. second mounting flange (of supporting tube)
79. socket (of supporting tube)
81. tapered segment (of supporting tube)
83. peripheral hole (of supporting tube)
85. underlying padding
87. ribs (of underlying padding)
89. channels (of underlying padding)
91. orifices (of underlying padding)
93. first axis of rotation
95. second axis of rotation
97. hole (of flange)
99. recess (of flange)
101. hole (of end plate of joint)
103. lower opening (ex. slit) (of joint)
105. skirting portion
107. fastener (for body shell)
109. compression spring
111. lodging area (for joint)
113. sealing rim (or sealing "perimeter")
115. though-hole (of clamping plate)
117. tooth (of clamping plate)
119. groove (of base plate)
121. range of rotation
123. complementary tool (ex. extension pole, vacuum hose, etc.)

Broadly described, the present invention, as exemplified in the accompanying drawings, relates to a sanding device (1) which comprises: a) a base plate (3) comprising opposite sanding and supporting surfaces (5,7); b) a joint (29) operatively mounted onto the supporting surface (7) of the base plate (3) and rotatable with respect to said base plate (3) about a first axis of rotation (93); and c) a supporting tube (69) operatively mounted onto the joint (29) and rotatable with respect to said joint (29) about a second axis of rotation (95).

The base plate (3) may include a substantially rigid support plate (3*a*), and an underlying padding (85) affixed to a bottom surface of the support plate (3*a*), the support plate (3*a*) and the underlying padding (85) being complementary in shape to one another and defining at least one orifice (17) of the base plate (3).

The underlying padding (85) has an operating surface for carrying a sanding application with the sanding device (1), and can be provided with a plurality of ribs (87) protruding from the operating surface and defining a plurality of channels (89) converging substantially towards at least one orifice (17) of the base plate (3) for directing sanded particles on the operating surface towards said at least one orifice (17).

At least one of said ribs (87) may extend over a corresponding orifice (17) of the base plate (3) in order to divide said corresponding orifice (17) into at least one sub-orifice (17*a*), and the base plate (3) and corresponding underlying padding (85) can be shaped accordingly for supporting said at least one of said ribs (87).

According to a possible embodiment, the support plate (3*a*) is made of an elastomeric material, and the underlying padding (85) is made of a rubber material.

Optionally also, the joint (29) is operatively mounted between first and second flanges (9,11) projecting from the supporting surface (7) of the base plate (3), the joint (29) being rotatable with respect to said first and second flanges (9,11).

The joint (29) may comprise first and second end plates (35,37) for removably mounting the joint (29) onto the first and second flanges (9,11) of the base plate (3) of the sanding device (1).

Also, the joint (29) may be operatively mountable between the first and second flanges (9,11) projecting from the supporting surface (7) of the base plate (3) by means of respective first and second mounting pins (31,33), said first and second mounting pins (31,33) defining the first axis of rotation (93) of the sanding device (1), for example.

According to a possible embodiment, the first and second mounting pins (31,33) are removably insertable into corresponding holes (97) provided respectively on the first and second flanges (9,11) of the base plate (3).

Alternatively, the first and second mounting pins (31,33) can be removably insertable onto corresponding recesses (99) provided respectively on the first and second flanges (9,11) of the base plate (3).

According to a possible embodiment, the first and second mounting pins (31,33) are removably insertable into corresponding holes (101) provided respectively on first and second end plates (35,37) of the joint (29).

Alternatively, the first and second mounting pins (31,33) are rigidly connected to and project from the first and second end plates (35,37) of the joint (29), respectively.

According to a possible embodiment, the joint (29) spans along a length of the base plate (3), between distal ends of said base plate (3), and is substantially cylindrical, and substantially hollow.

According to another possible embodiment, the joint (29) comprises a lower opening (103) (ex. slit, etc.) in fluid communication with at least one orifice (17) of the base plate (3) (ex. for receiving sanded particles from said at least one orifice (17)).

The sanding device (1) may also comprise a pair of skirting sections (105) (ex. walls, surfaces, etc.) extending between first and second flanges (9,11) projecting from the supporting surface (7) of the base plate (3), said skirting (105) sections being complementary in shape to that of the rotatable joint (29) extending between the first and second flanges (9,11) and surrounding the lower opening (103) of the joint (29).

The skirting portions may be made integral (ex. made of a single piece and/or material) to the base plate (3), or they can be provided by a body shell (3*b*) being removably mountable onto the base plate (3).

According to a possible embodiment, the body shell (3*b*) is removably mountable onto the base plate (3) by means of fasteners (107), as can be easily understood when referring to FIGS. 19-23.

The body shell (3*b*) may be positioned, shaped and sized so as to a) provide a lodging area (111) for the joint (29); b) cover first and second flanges (9,11) projecting from the supporting surface (7) of the base plate (3); and c) provide an operative sealing rim or "perimeter" (113) about the joint (29).

Figure 19:
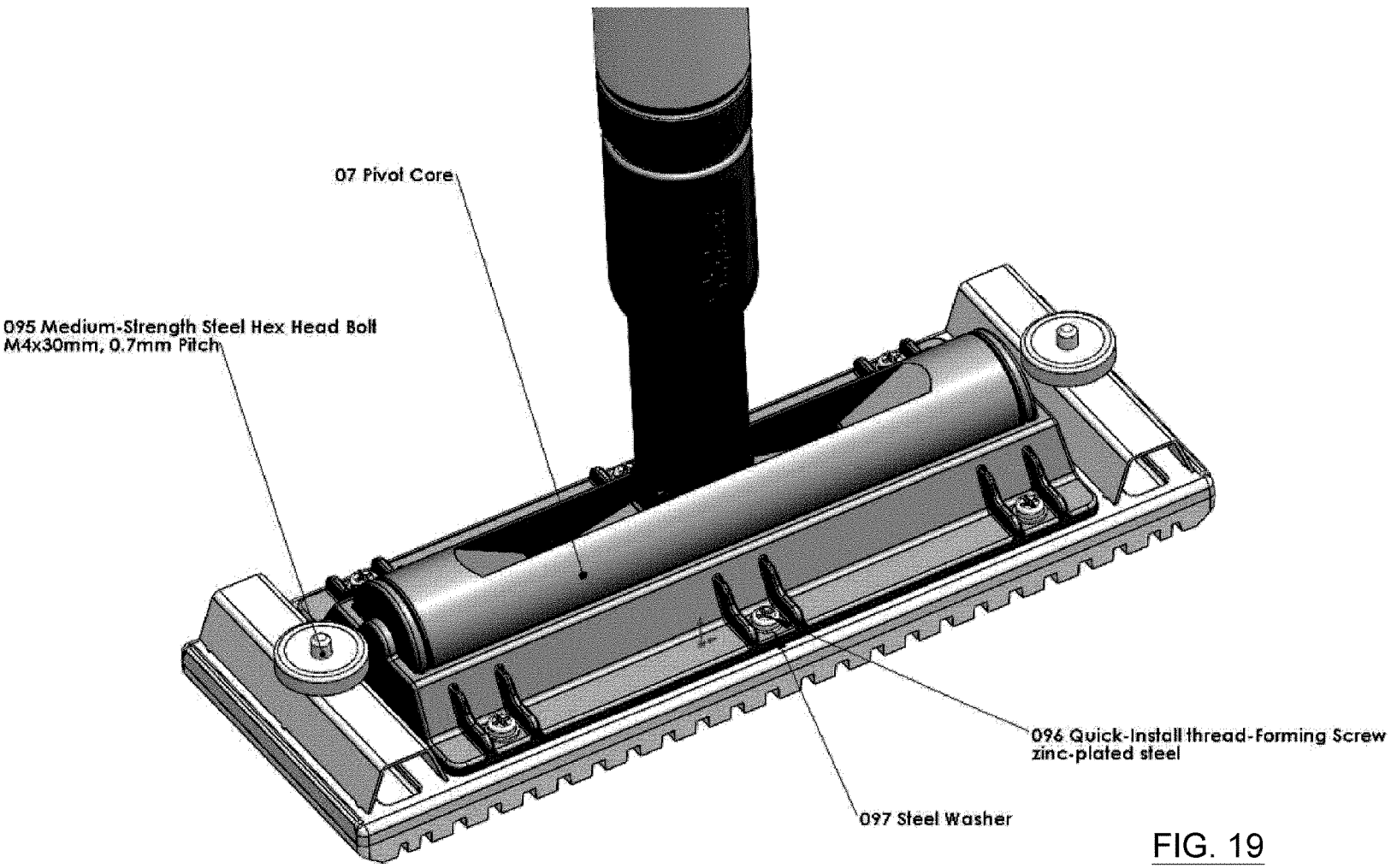
Figure 20:
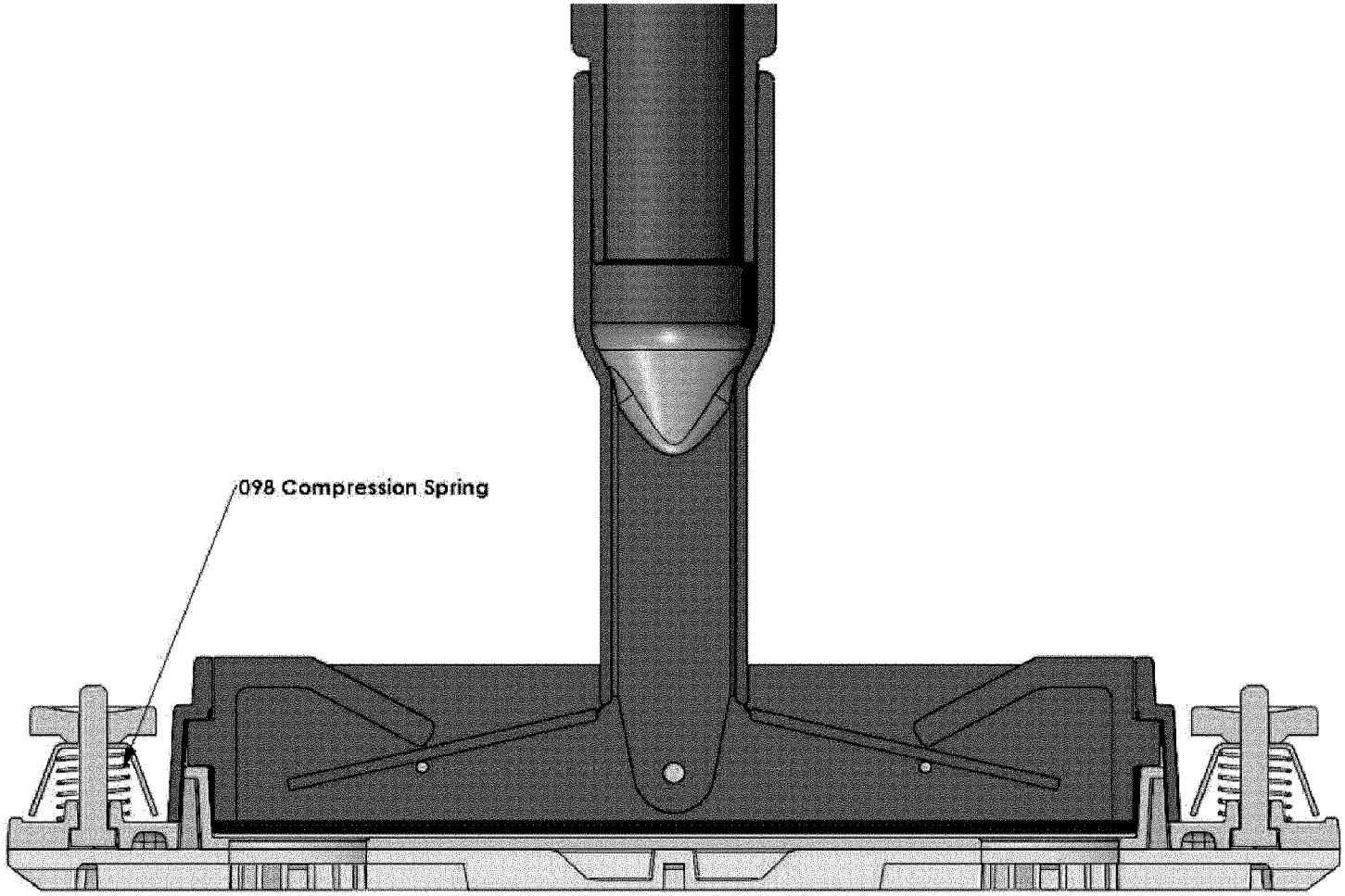
Figure 21:
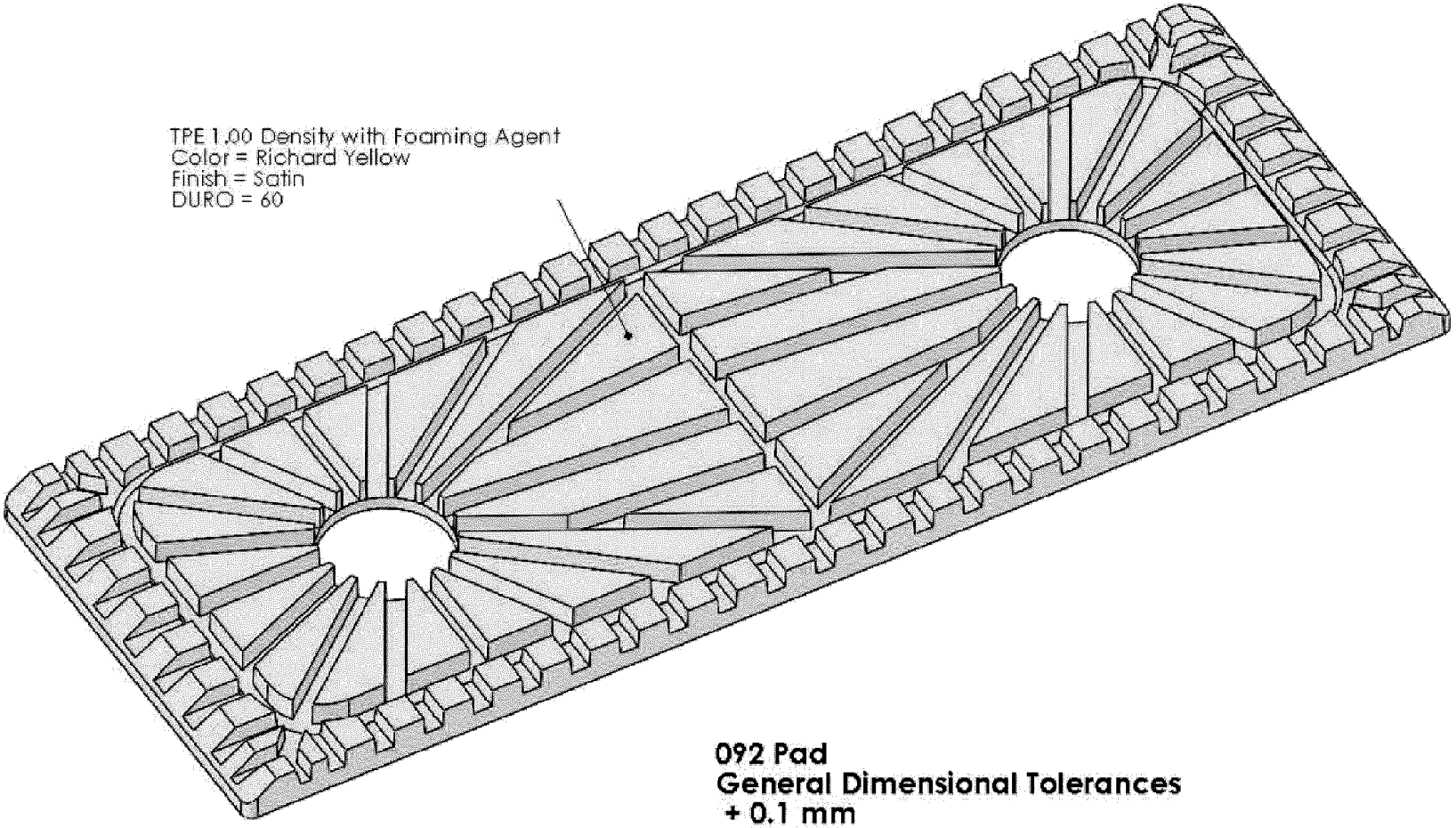
Figure 22:
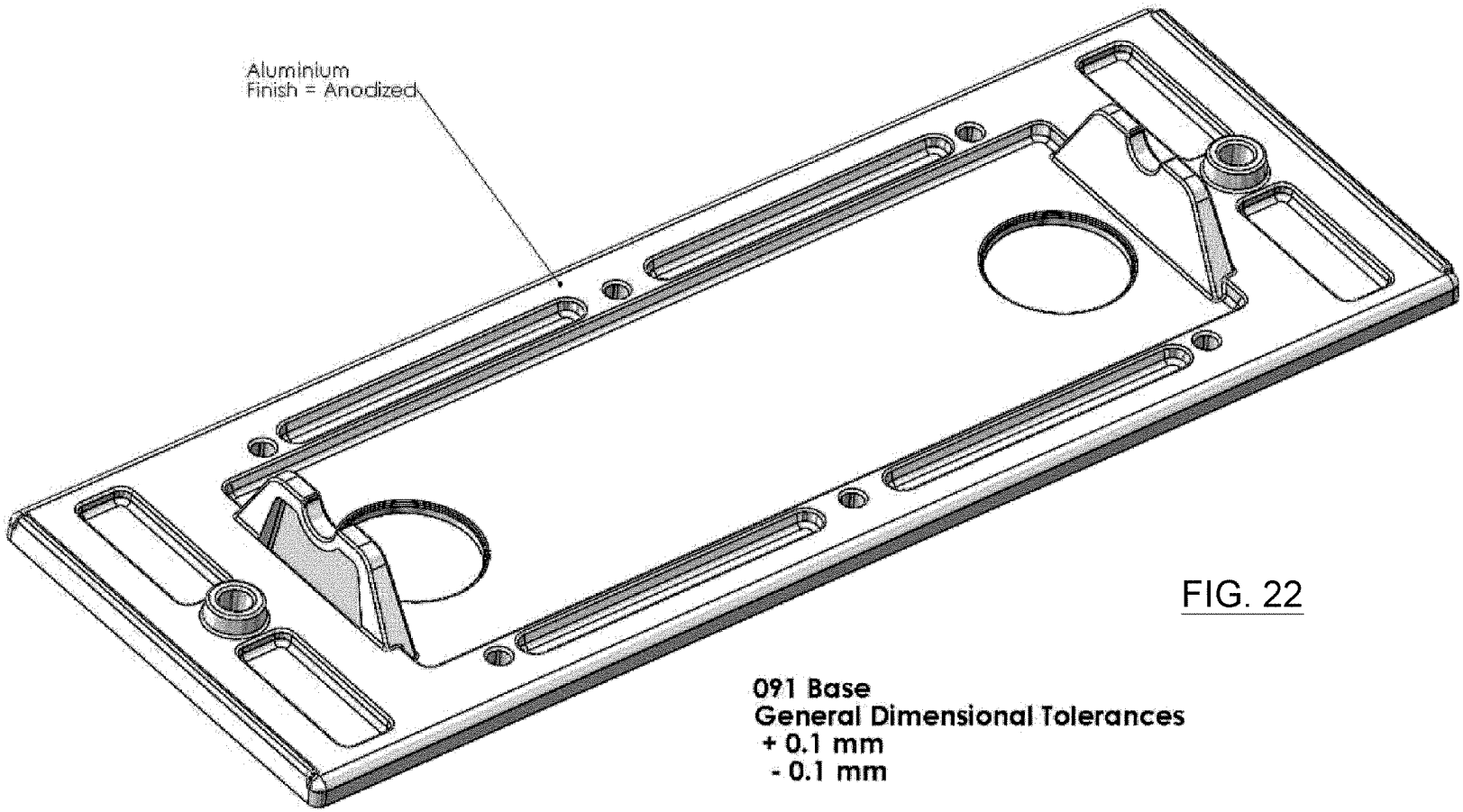
Figure 23:
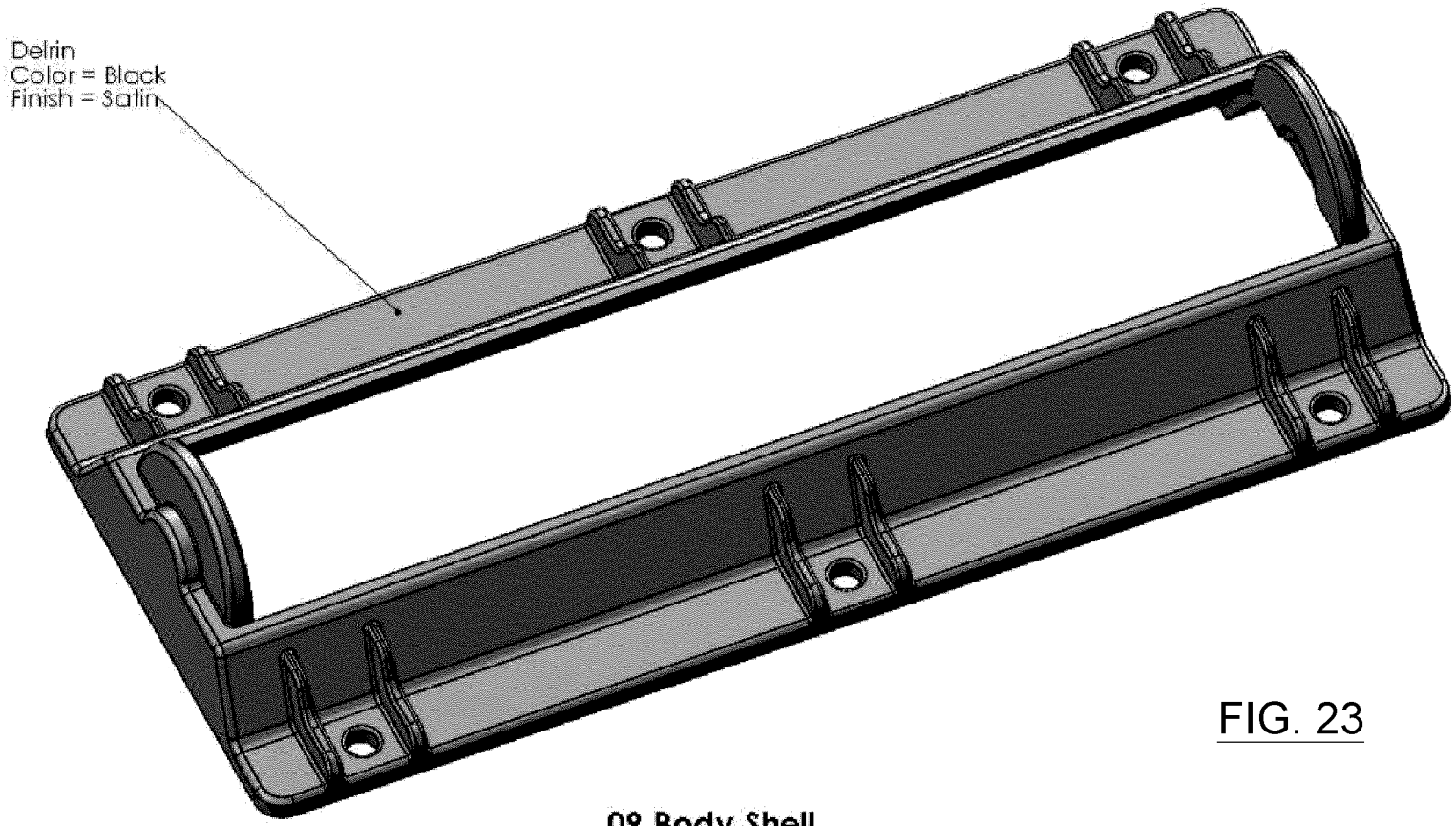
Figure 24:
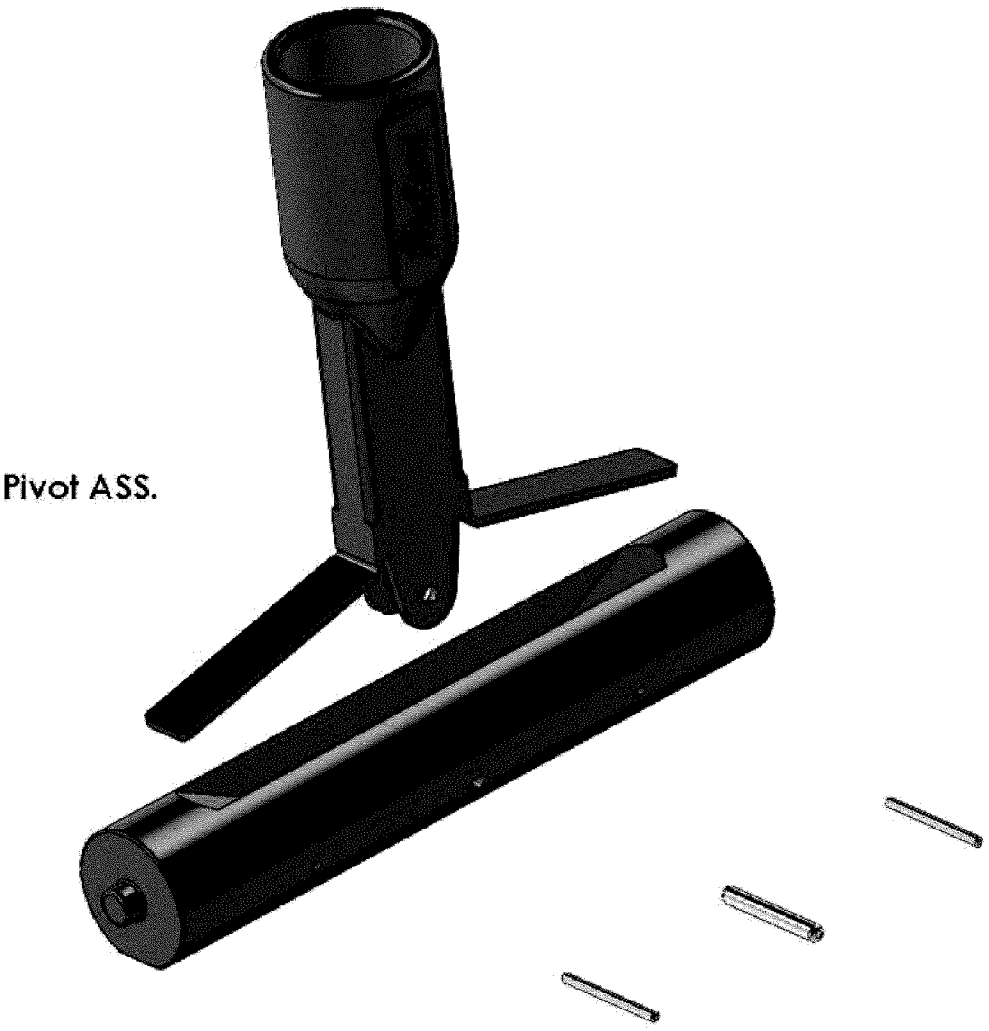
Figure 25:
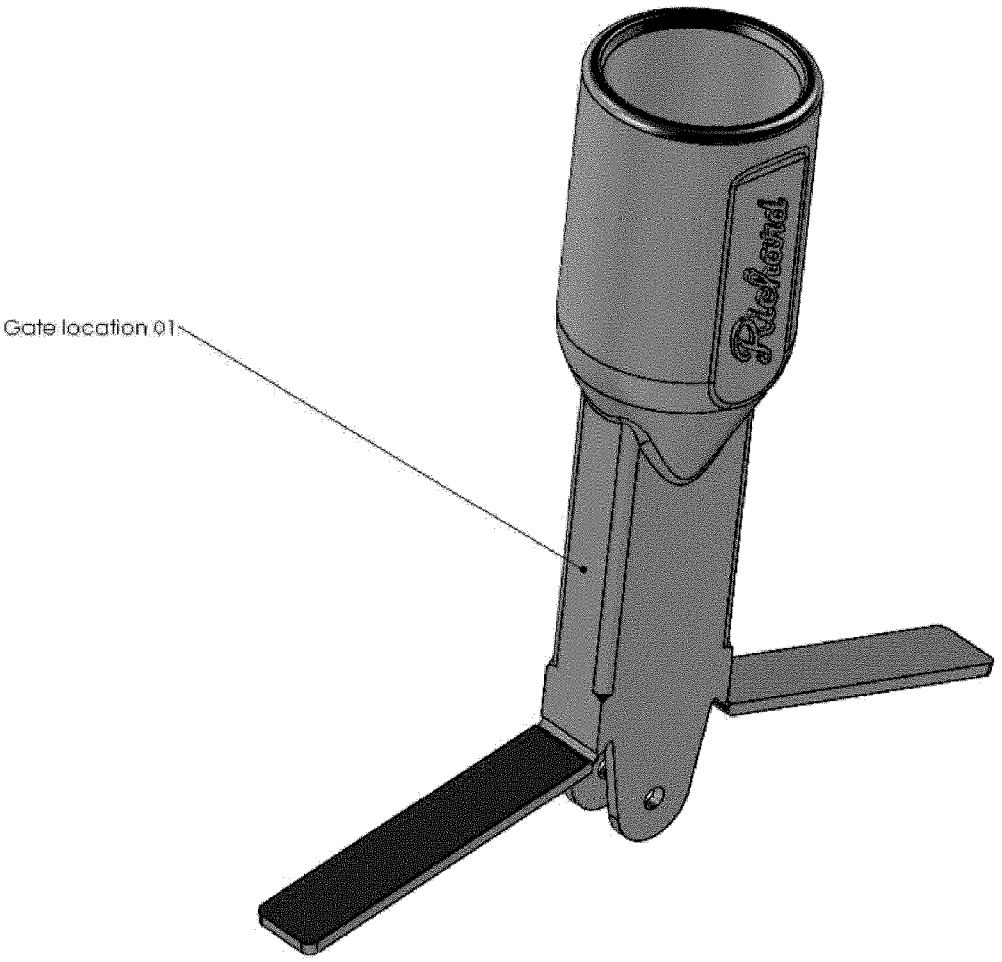
Figure 26:
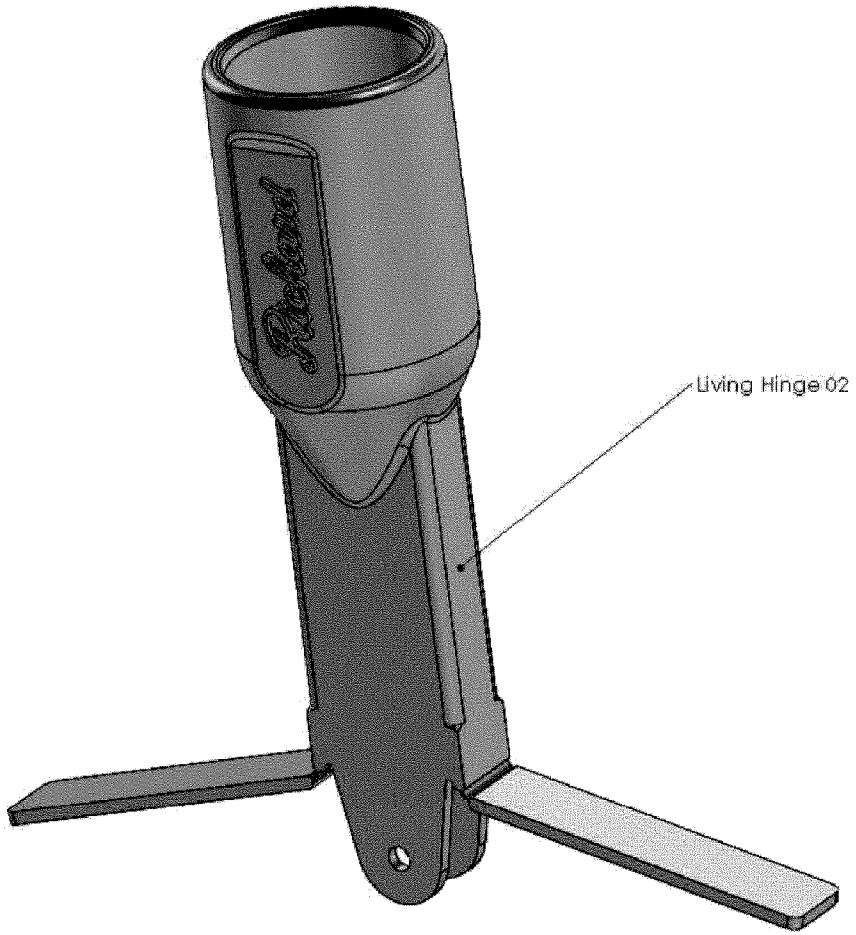
Figure 27:
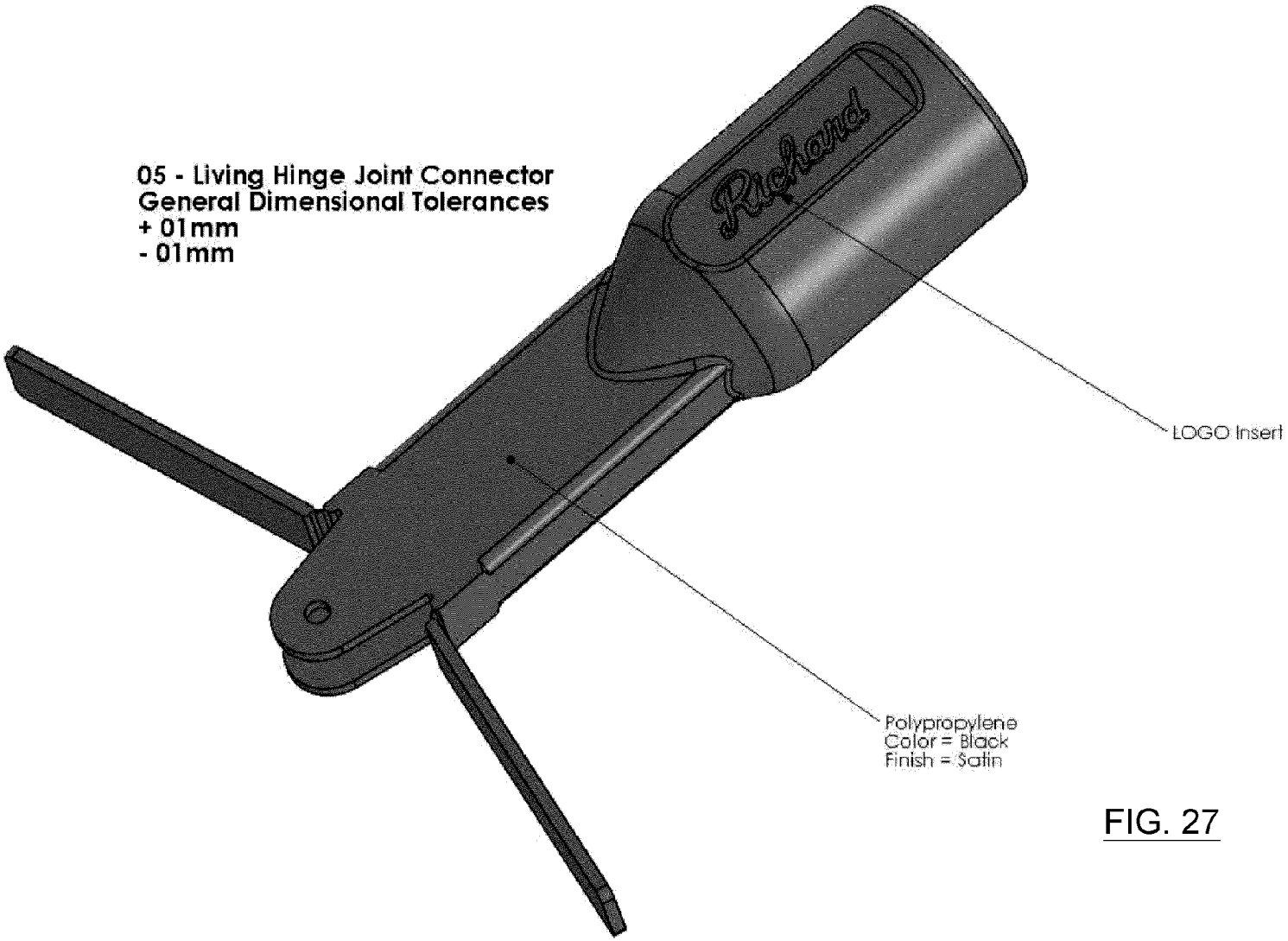
Figure 28:
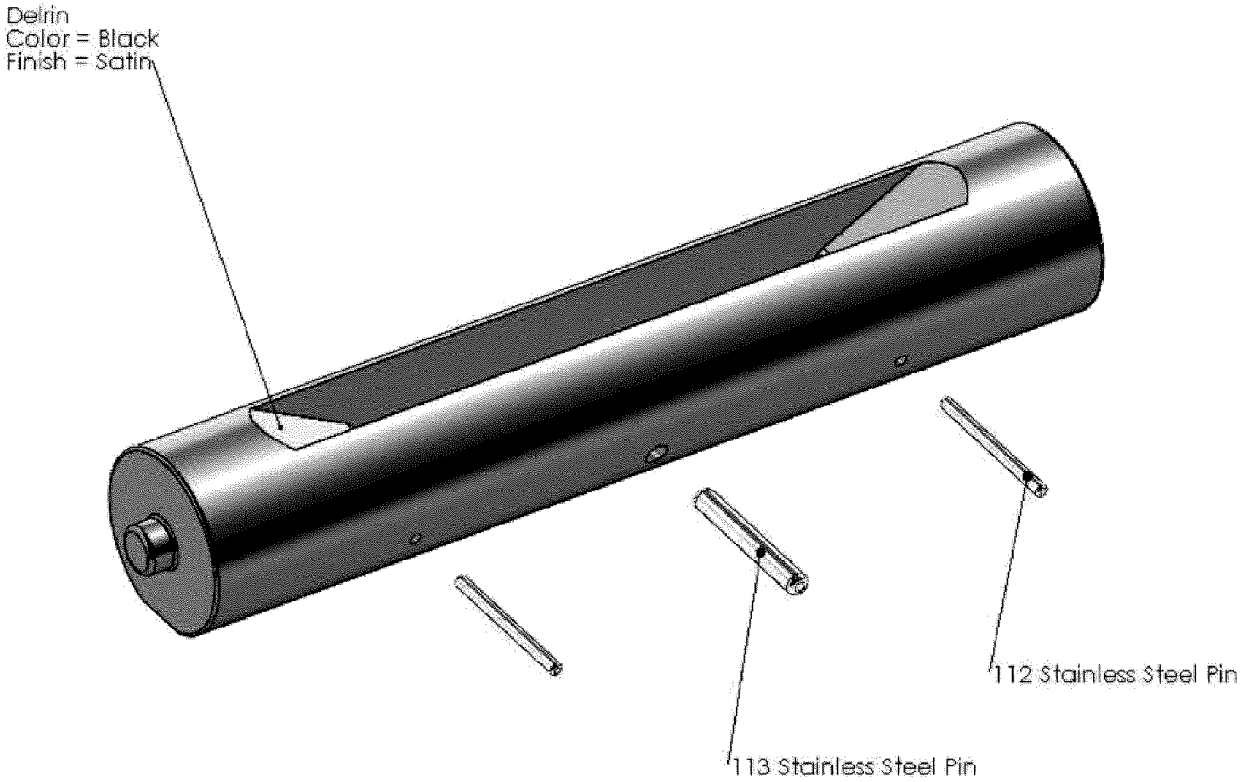

As better shown in FIGS. 19 and 23, the operative peripheral sealing rim (113) can be substantially rectangular.

Also, the sanding device (1) may comprise first and second rims (13,15), said first and second rims (13,15) being preferably positioned distally with respect to one another along the base plate (3).

The sanding device (1) may also comprise at least one fastening device (21) for removably clamping at least one corresponding extension of a sanding meshing extendable over an operating surface of an underlying padding (85) of the base plate (3).

According to a possible embodiment, the sanding device (1) comprises first and second fastening devices (21), each fastening device (21) being positioned onto the base plate (3) adjacent to a distal end of said base plate (3).

Each fastening device (21) may be positioned onto the base plate (3) adjacent to a distal rim (13,15) of said base plate (3).

According to a possible embodiment, each fastening device (21) comprises a clamping plate (23), a fastener (25) and a corresponding tightening component (27), the fastener (25) being insertable into a corresponding through-hole (19) of the base plate (3) so as to project out from the supporting surface (7) of the base plate (3).

Each fastening device (21) may include a compression spring (109) operatively extendable between the clamping plate (23) and the base plate (3).

According to a possible embodiment, the clamping plate (23) is substantially U-shaped, and comprises a through-hole (115) for receiving a corresponding fastener (25) of the fastening device (21), as well as at least one tooth (117) for engaging a corresponding sanding meshing to be used with the sanding device (1).

The tightening component (27) may include a nut, and according to a possible embodiment, the tightening component (27) includes a nut provided with at least one projection, such as a pair of projections (ex. "rabbit ears", etc.).

Figure 31:
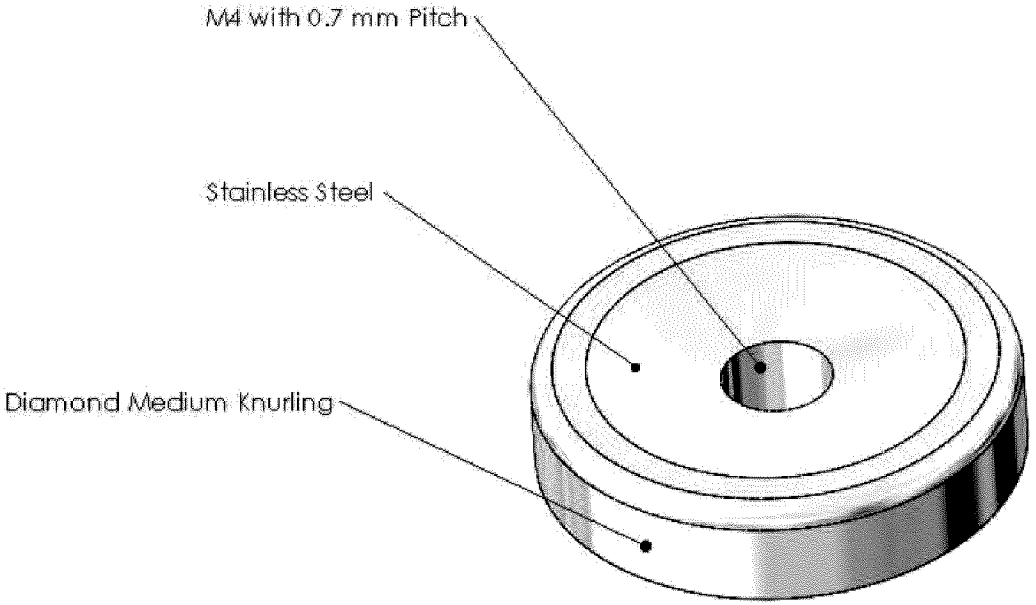

Alternatively, the tightening component (27) may include a thumb nut, and according to a possible embodiment, the thumb nut is a circular thumb nut, as better shown in FIGS. 19 and 31.

According to a possible embodiment, the base plate (3) may comprise at least one groove (119) provided on the sanding surface (5) (ex. bottom surface of the support plate of the base plate (3)) for receiving a corresponding head of each fastener (25) of each fastening device (21), and each fastening device (21) can be positioned about the base plate (3) adjacent to a distal rim (13, 15) of said base plate (3).

According to a possible embodiment, the joint (29) comprises a recess (39), and the recess can be an upper longitudinal recess (39), defining a plane intersecting with the first axis of rotation (93).

According to a possible embodiment, the sanding device (1) comprises at least one sealing member (57, 59) disposed between the supporting tube (69) and a corresponding recess (39) of the joint (29).

Each sealing member (57,59) can be slidably moveable between a shoulder (41,43) and a guiding pin (47,49) of the joint (29) when the supporting tube (69) is rotated with respect to the joint (69) of the sanding device (1).

According to a possible embodiment, a range of rotation of the supporting tube (69) with respect to the joint (29) of the sanding device (1) is delimited along at least one direction by at least one corresponding shoulder (41,43) of the joint (29).

According to another possible embodiment, the range of rotation (121) of the support tube (69) is about 120° along a first given direction, and about 120° along a second given direction.

A range of travel of a sealing member (57,59) can also be delimited within the joint (29) by a corresponding abutment section (53,55) of the joint (29), although other means could be contemplated.

According to another possible embodiment, the sanding device (1) comprises first and second sealing members (57,59), and the joint (29) comprises corresponding first and second shoulders (41,43), with corresponding first and second guiding pins (47,49), and corresponding first and second abutment sections (53,55).

According to a possible embodiment, a delimitation of range of rotation (121) of the supporting tube (69) with respect to the joint (29) of the sanding device (1) along one side of the sanding device (1) corresponds to a delimitation of range of travel of a corresponding sealing member (57,59) of said one side of the sanding device.

Each sealing member (57,59) may be removably connectable to the supporting tube (69) via at least one hinge (61,63). Each hinge (61, 63) may comprise at least one male component (65) removably insertable into a corresponding female component (67) of the sanding device (1). Also, the supporting tube (69) of the sanding device (1) may comprise at least one female component (67) configured for receiving a male component (65) of a corresponding hinge (61,63). Also, each sealing member (57,59) of the sanding device (1) may comprise at least one female component (67) configured for receiving a male component (65) of a corresponding hinge (61,63). Alternatively, each hinge (61,63) can be made integral with the supporting tube (69), as better shown in FIGS. 24-27.

According to a possible embodiment, each hinge (61,63) is flexible, and is made of a rubberized (ex. elastic, etc.) material, for example.

Figure 10:
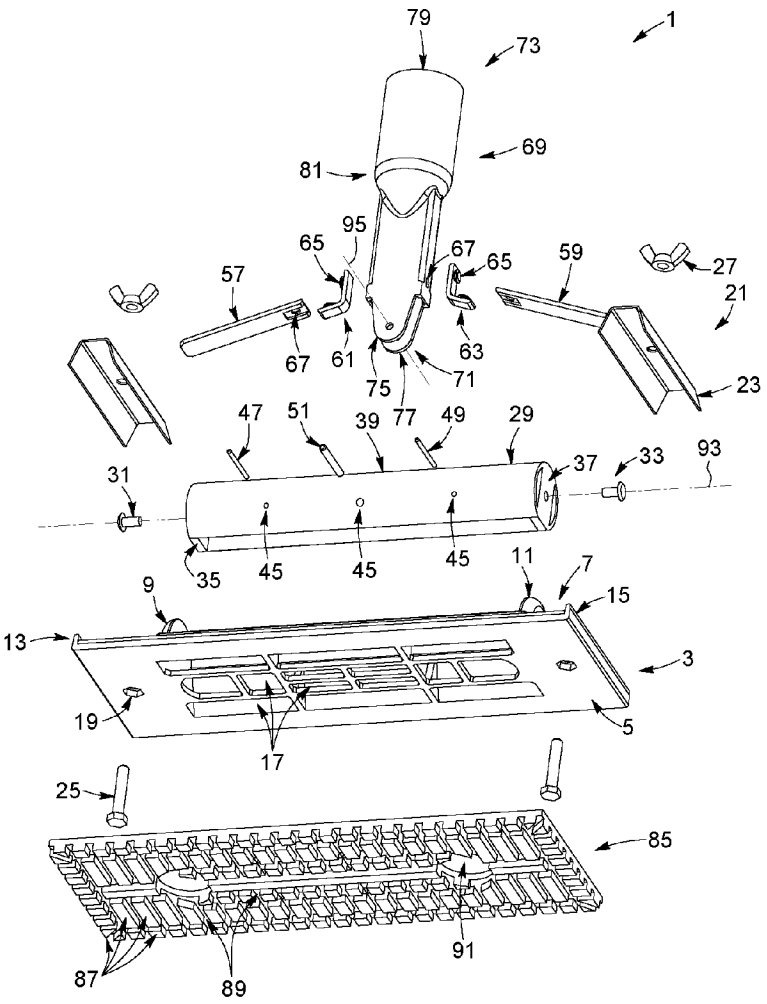
Figure 11:
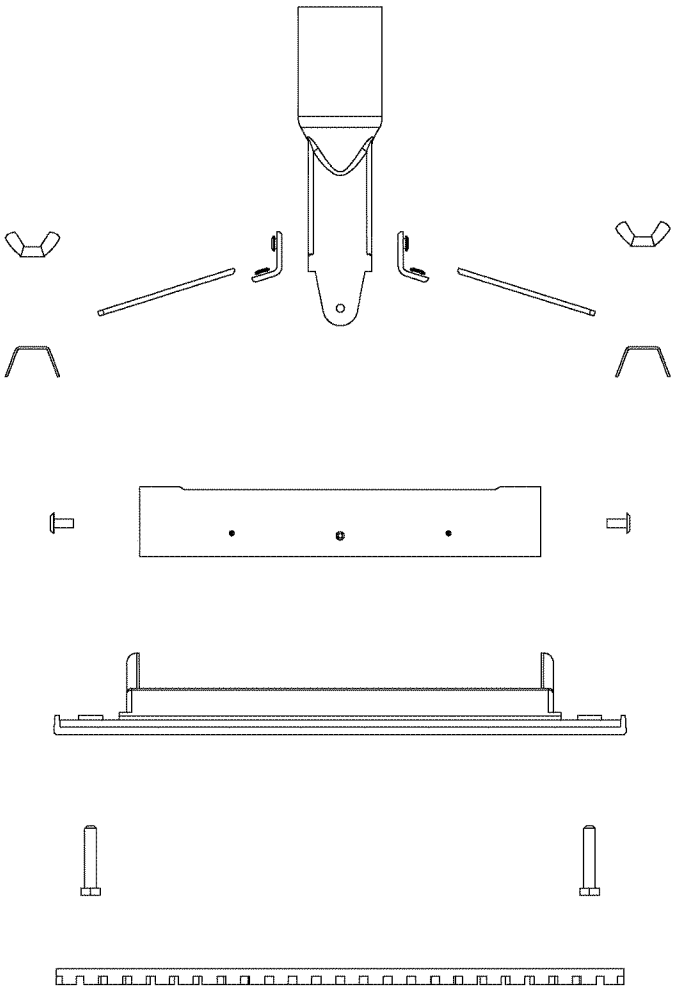
Figure 12:
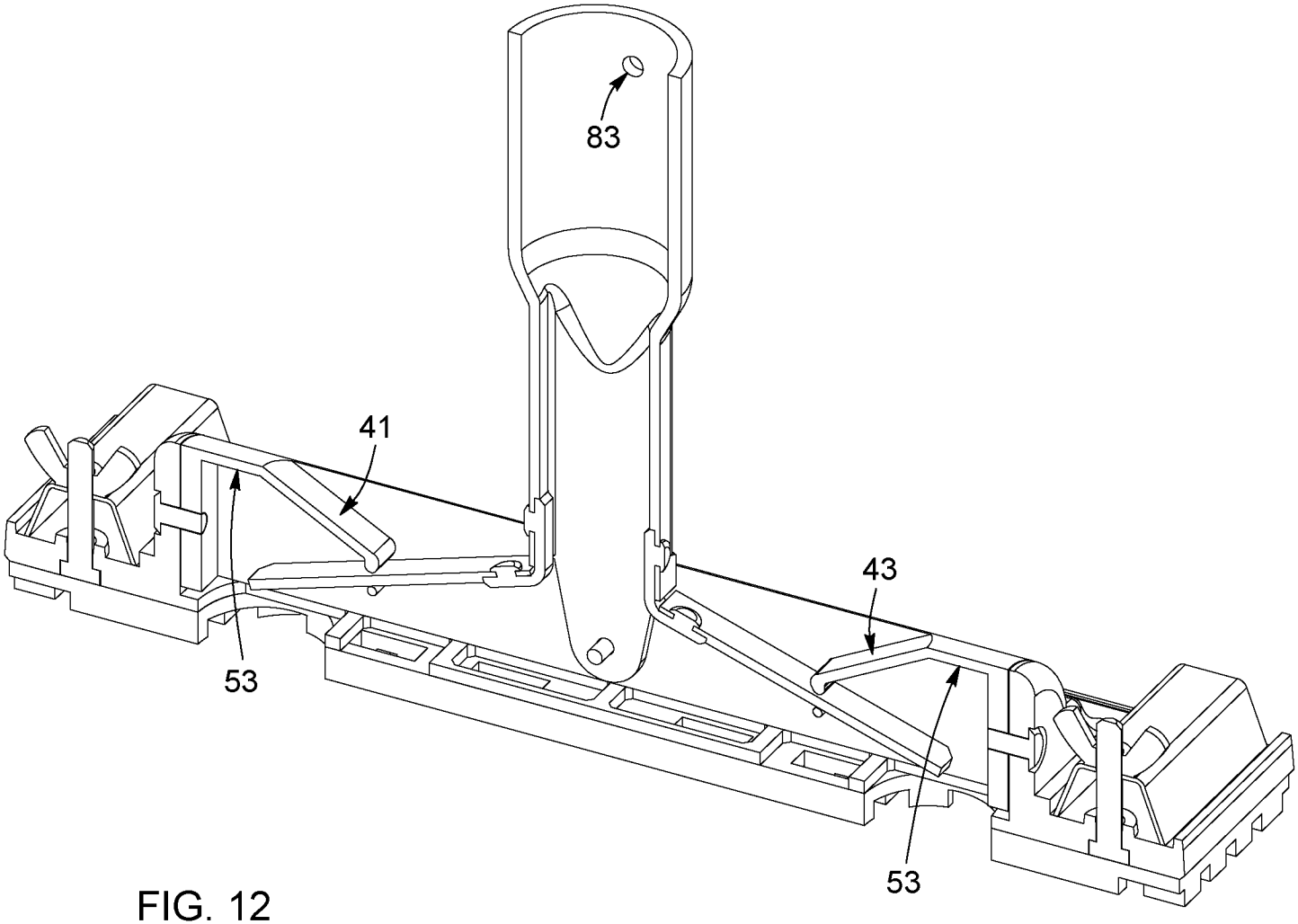
Figure 13:
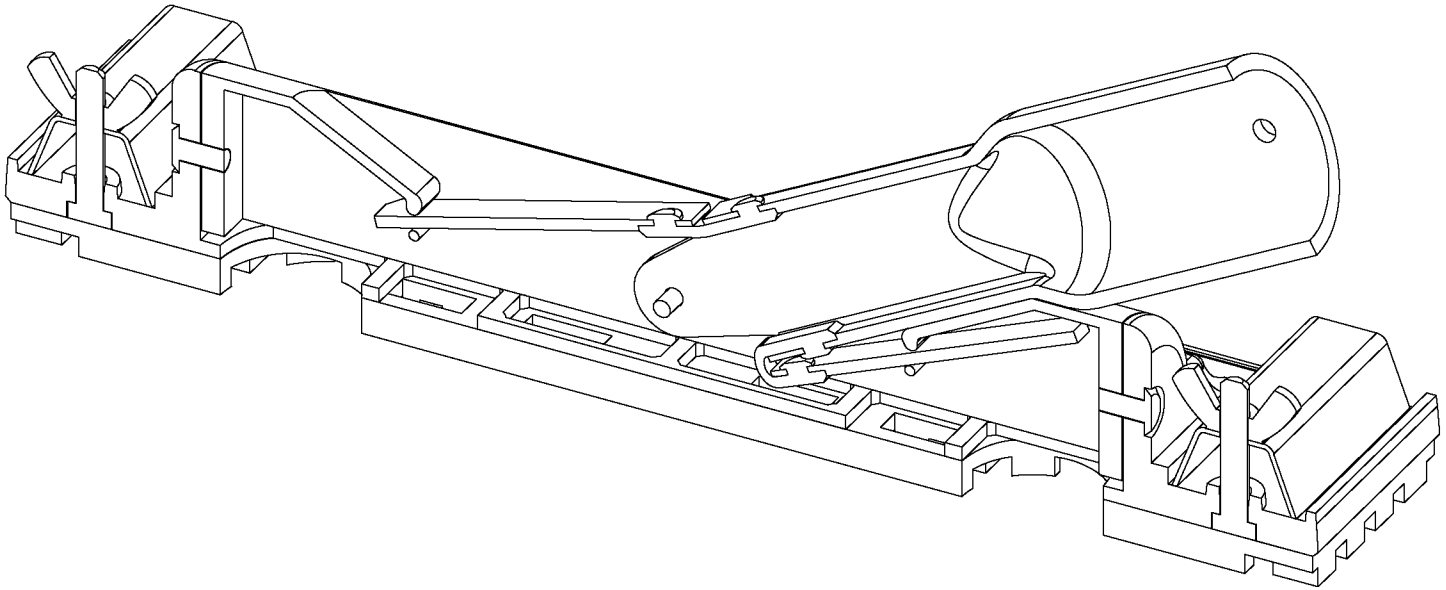
Figure 14:
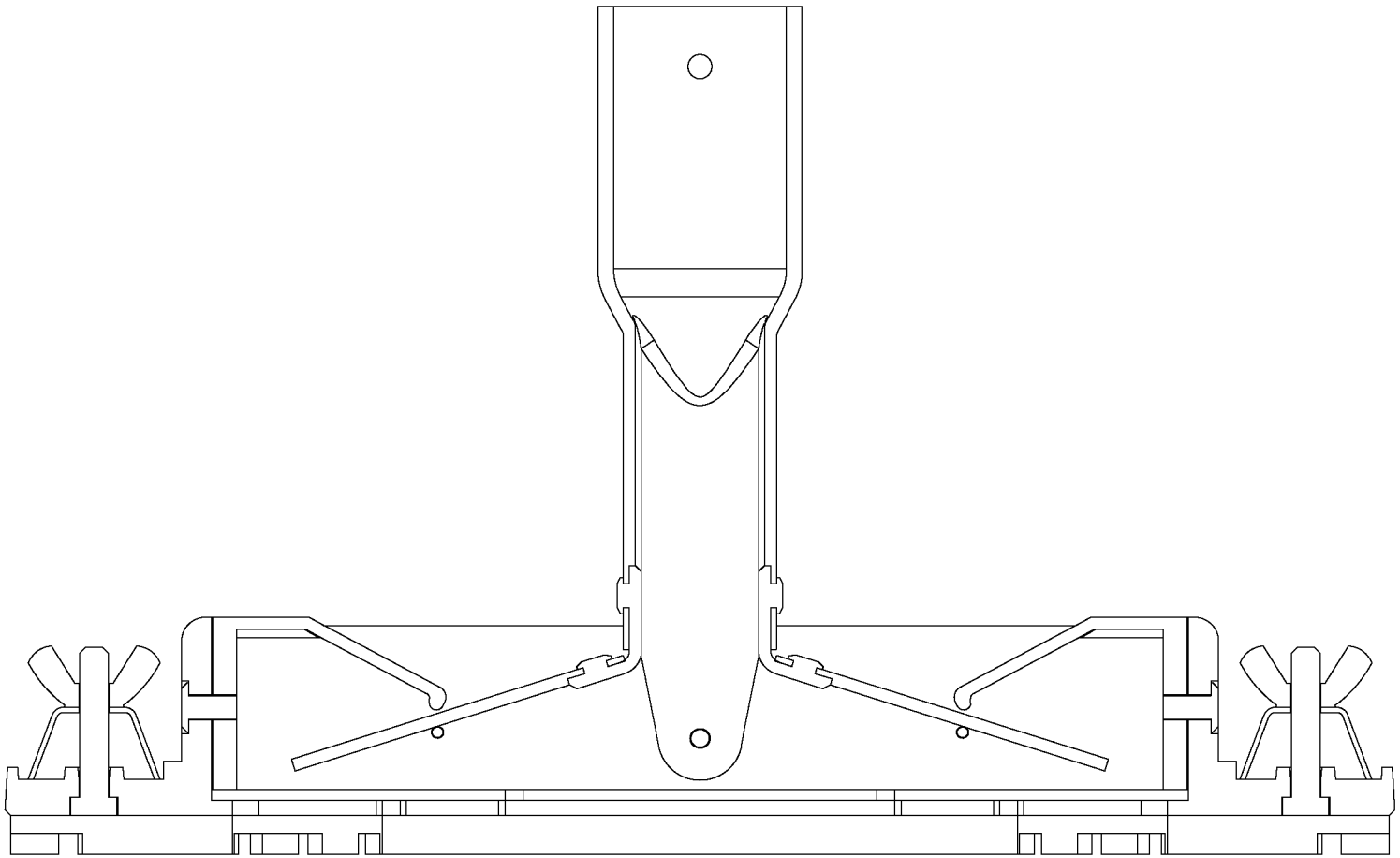
Figure 15:
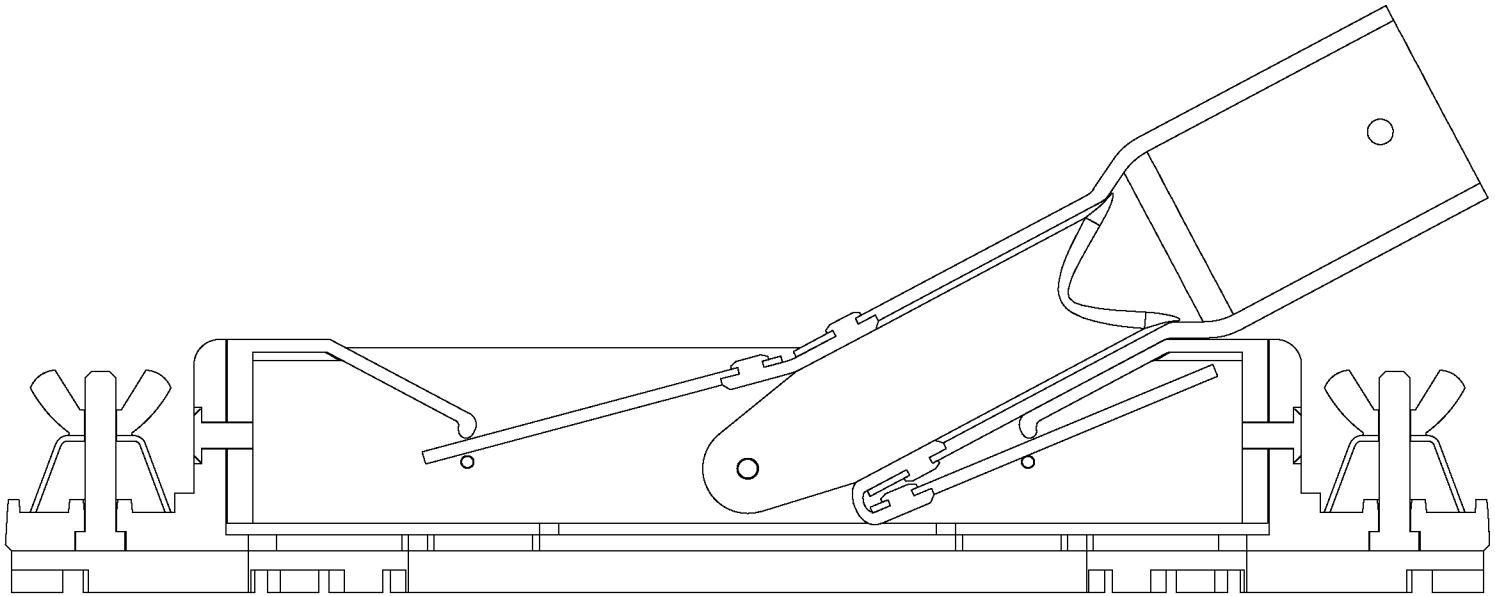
Figure 16:
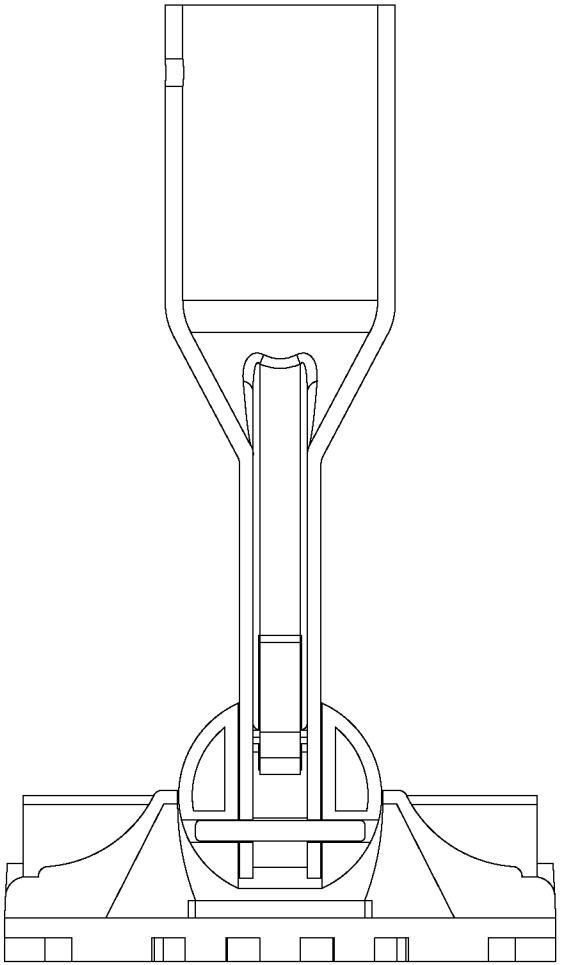
Figure 17:
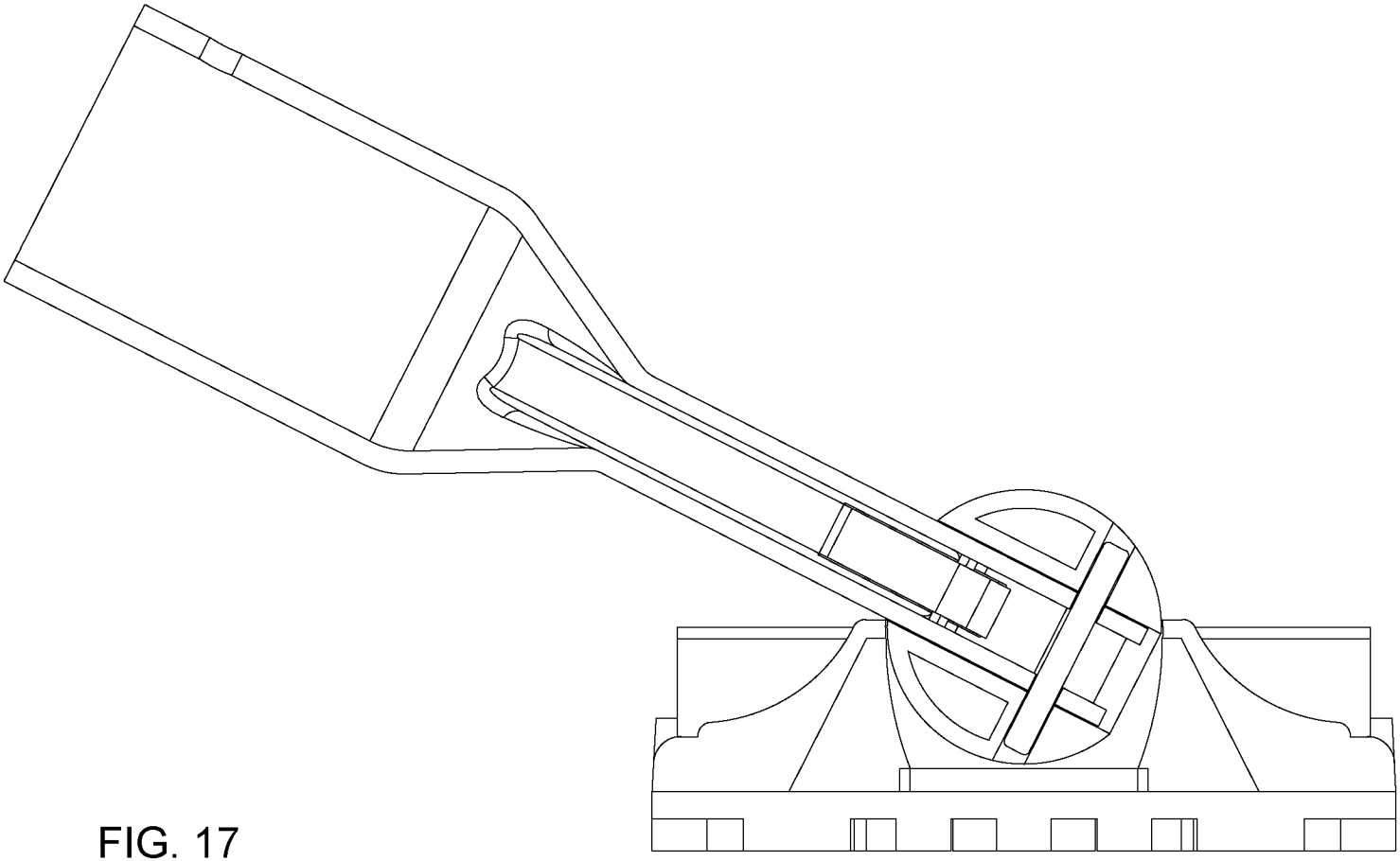
Figure 18:
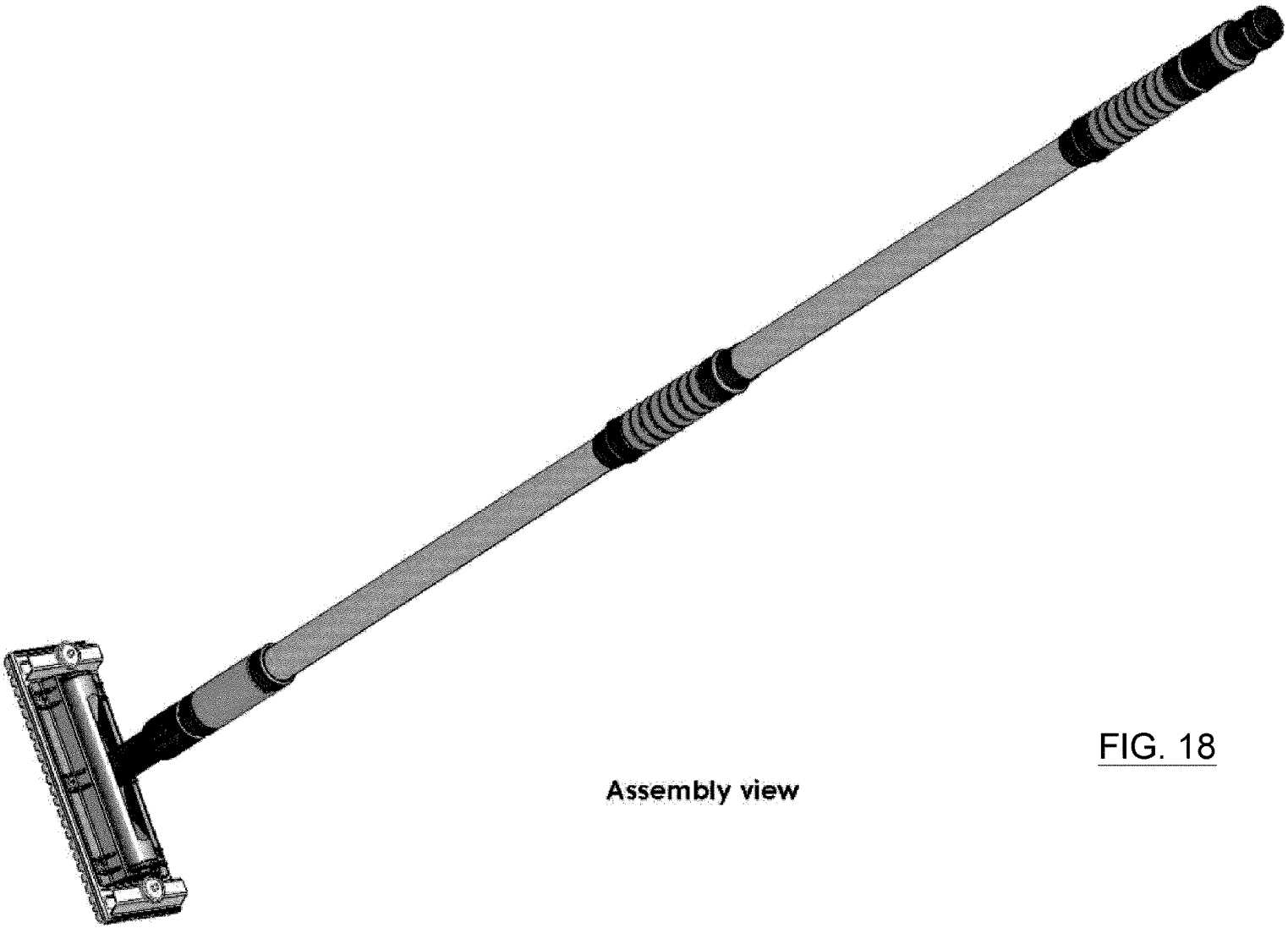
FIGS. 18-31 are different views of a sanding device according to another possible preferred embodiment of the present invention.
Figure 29:
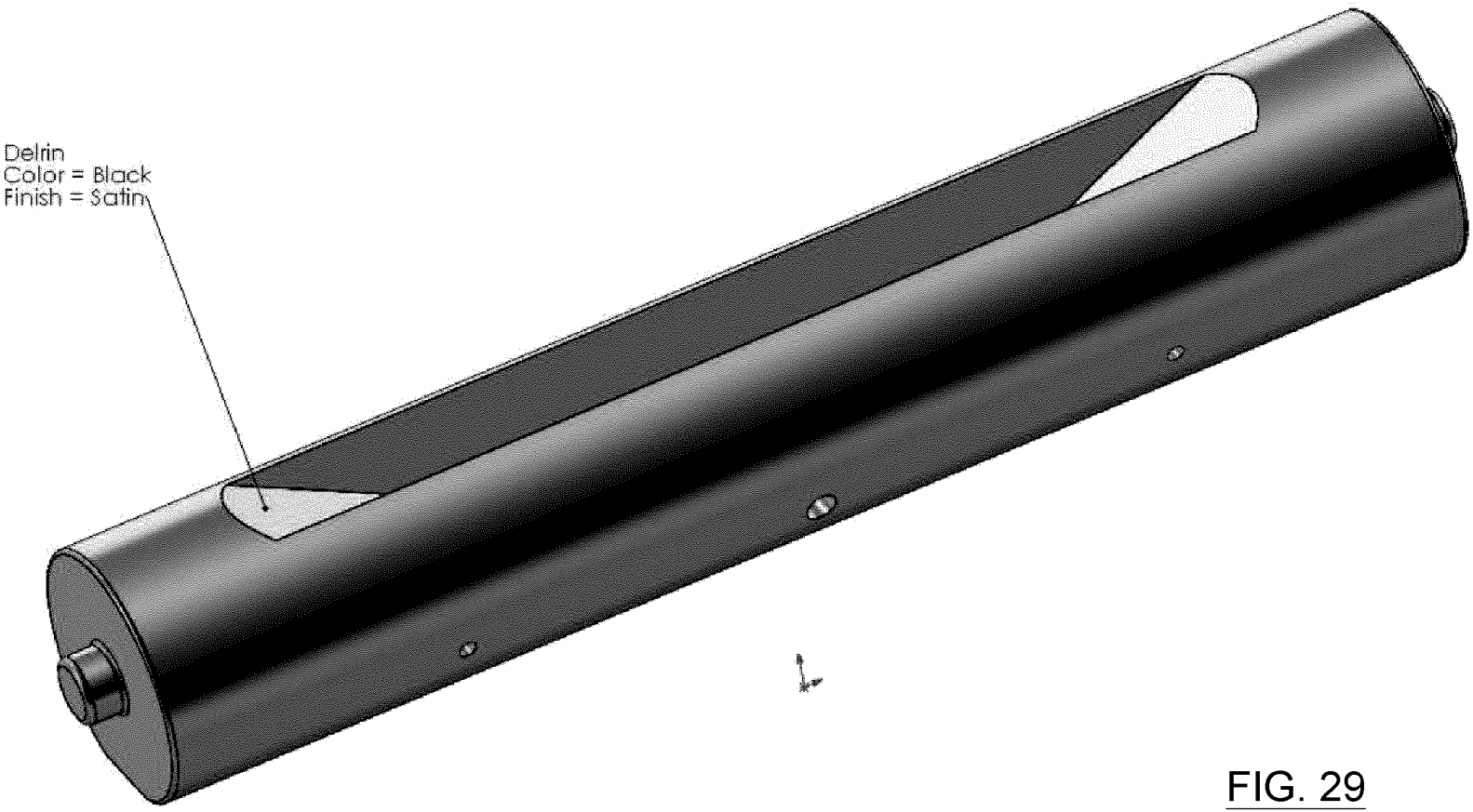
Figure 30:
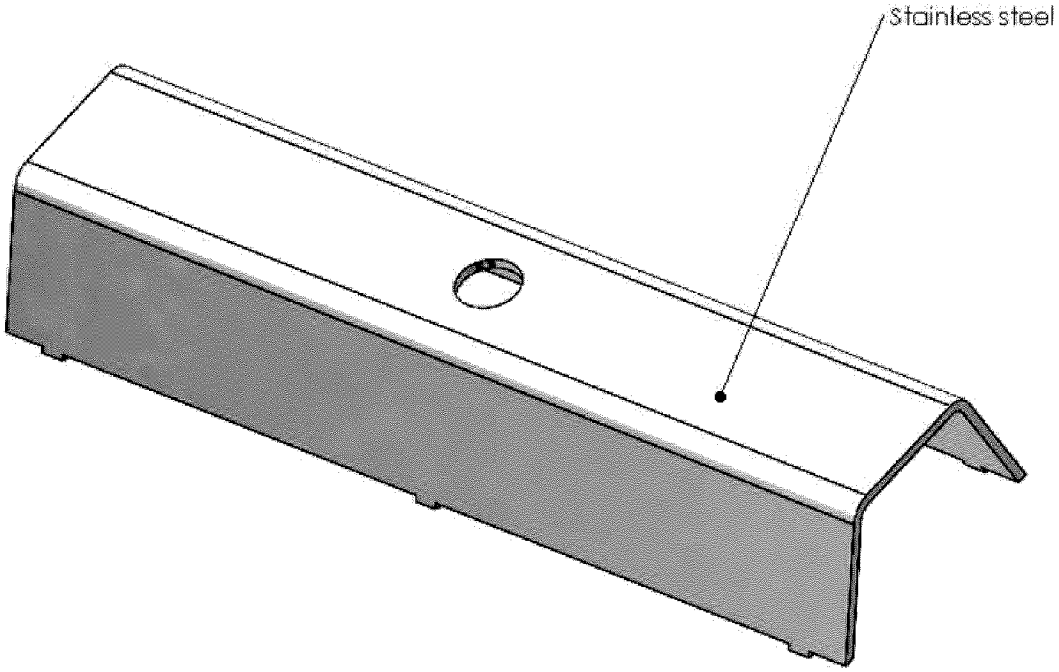

As better shown in FIGS. 10 and 29, for example, the joint (29) may comprise at least one transversal bore hole (45) for receiving a guiding pin (47,49) configured for receiving a corresponding sealing member (57,59), a corresponding sealing member (57,59) being slidably moveable about (ex. over, on, against, etc.) said guiding pin (47,49).

According to a possible embodiment, the joint (29) comprises first and second transversal bore holes (45) for receiving respectively first and second guiding pins (47,49) configured for receiving corresponding first and second sealing members (57,59), each sealing member (57,59) being slidably moveable about (ex. over, on, against, etc.) a corresponding guiding pin (47,49).

Also, the joint (29) preferably comprises at least one transversal bore hole (45) for receiving a mounting pin (51) configured for receiving the supporting tube (69), the supporting tube being rotatable about said mounting pin (51).

The first end (71) of the supporting tube (69) may comprise at least one mounting flange (75,77) for mounting about the mounting pin (51) of the joint (29) so as to allow the supporting tube (69) to rotate with respect to said joint (29).

According to a possible embodiment, the first end (71) of the supporting tube (69) comprises first and second mounting flanges (75,77) for mounting about the mounting pin (51) of the joint (29) so as to allow the supporting tube (69) to rotate with respect to said joint (29), with the mounting pin (51) defining the second axis of rotation (95), and a first end (71) of the supporting tube (69) being open-ended, and a second end (73) of the supporting tube (69) being open-ended, as well, for example.

The second end (73) may be provided with a socket (79) for receiving a complementary tool (123) (ex. an extension pole, a hose of a vacuum system, etc.).

According to a possible embodiment, the supporting tube (69) comprises a tapered section (81) between its first and second ends (71, 73).

The supporting tube (69) may comprise a peripheral hole (83) for receiving a corresponding component (ex. fastener) meant to cooperate with a complementary tool (123).

The sanding surface (5) of the base plate (3) may comprise a central portion disposed between a pair of side portions, with the central portion of the sanding surface (5) comprising a higher concentration of orifices (17) than that of the side portions. Also, orifices (17) of the central portion of the sanding surface (5) may be generally narrower than the orifices (17) of the side portions, although various configurations and layouts are contemplated with the present sanding device (1).

Various manufacturing and/or assembling methods may be used, but according to a possible embodiment, pins (ex. mounting pin, guiding pin, etc.) of the sanding device (1) are press-fitted into corresponding holes (ex. bores, etc.).

As may now better be appreciated, the present invention is a substantial improvement over the prior art in that, by virtue of its design and components, as explained herein, and the particular configuration of the joint and sealing members thereof, the sanding tool according to the present invention enables for a quicker, easier, simpler and more effective manner than what is possible with respect to other sanding tools available in the prior art.

Indeed, among the different advantages resulting from the present sanding device, the particular design of the joint and sealing members (ex. with flexible hinges), in the manner in which they cooperate with the supporting tube, as can be easily understood by a person skilled in the art, in the light of the preceding description and accompanying drawings, enable a vacuum chamber to be created inside the rotatable joint, when the sanding device is used with a vacuum system, for example, so as to enable for improved sanding results in term of performance, efficiency, surface quality finish, etc.), and also in terms of suction and/or evacuation of sanded particles, irrespectively of the positioning (ex. rotational angle, etc.) of the rotatable joint and/or of the pivoting supporting tube, etc.

In ending, the scope of the claims should not be limited by the preferred embodiments set forth in the examples, but should be given the broadest interpretation consistent with the description as a whole.

The invention claimed is:

1. A sanding device comprising:

a base plate comprising opposite sanding and supporting surfaces;

a joint operatively mounted onto the supporting surface of the base plate and rotatable with respect to said base plate about a first axis of rotation, the joint being substantially hollow; and a supporting tube operatively mounted onto the joint and rotatable with respect to said joint about a second axis of rotation; and at least one sealing member disposed between the supporting tube and a corresponding recess of the joint.

2. A sanding device according to claim 1, wherein the joint spans along a length of the base plate, between distal ends of said base plate.

3. A sanding device according to claim 1, wherein the joint is substantially cylindrical.

4. A sanding device according to claim 1, further comprising at least one fastening device for removably clamping at least one corresponding extension of a sanding meshing extendable over an operating surface of an underlying padding of the base plate; wherein each fastening device comprises a clamping plate, a fastener and a corresponding tightening component, the fastener being insertable into a corresponding through-hole of the base plate so as to project out from the supporting surface of the base plate.

5. A sanding device according to claim 4, wherein each fastening device includes a compression spring operatively extendable between the clamping plate and the base plate; wherein the clamping plate is substantially U-shaped; wherein the clamping plate comprises a through-hole for receiving a corresponding fastener of the fastening device; and wherein the clamping plate comprises at least one tooth for engaging a corresponding sanding meshing to be used with the sanding device.

6. A sanding device according to claim 1, wherein the joint comprises an upper longitudinal recess, said upper longitudinal recess defining a plane intersecting with the first axis of rotation.

7. A sanding device according to claim 1, wherein each sealing member is slidably moveable between a shoulder and a guiding pin of the joint when the supporting tube is rotated with respect to the joint of the sanding device.

8. A sanding device according to claim 1, wherein a range of rotation of the supporting tube with respect to the joint of the sanding device is delimited along at least one direction by at least one corresponding shoulder of the joint.

9. A sanding device according to claim 8, wherein the range of rotation of the support tube is about 120° along a first given direction, and about 120° along a second given direction.

10. A sanding device according to claim 1, wherein a range of travel of a sealing member is delimited within the joint by a corresponding abutment section of the joint.

11. A sanding device according to claim 1, wherein the sanding device comprises first and second sealing members, and wherein the joint comprises corresponding first and second shoulders, with corresponding first and second guiding pins, and corresponding first and second abutment sections.

12. A sanding device according to claim 1, wherein a delimitation of range of rotation of the supporting tube with respect to the joint of the sanding device along one side of the sanding device corresponds to a delimitation of range of travel of a corresponding sealing member of said one side of the sanding device.

13. A sanding device according to claim 12, wherein each sealing member is removably connectable to the supporting tube via at least one hinge.

14. A sanding device according to claim 13, wherein each hinge comprises at least one male component removably insertable into a corresponding female component of the sanding device.

15. A sanding device according to claim 13, wherein the supporting tube of the sanding device comprises at least one female component configured for receiving a male component of a corresponding hinge.

16. A sanding device according to claim 12, wherein each sealing member of the sanding device comprises at least one female component configured for receiving a male component of a corresponding hinge.

17. A sanding device according to claim 13, wherein each hinge is flexible.

18. A sanding device according to claim 12, wherein each hinge is made integral with the supporting tube.

19. A sanding device according to claim 1, wherein the joint comprises at least one transversal bore hole for receiving a guiding pin configured for receiving a corresponding sealing member, a corresponding sealing member being slidably moveable about said guiding pin.

20. A sanding device according to claim 1, wherein the joint comprises first and second transversal bore holes for receiving respectively first and second guiding pins configured for receiving corresponding first and second sealing members, each sealing member being slidably moveable about a corresponding guiding pin.

21. A sanding device comprising:

a base plate comprising opposite sanding and supporting surfaces;

a joint operatively mounted onto the supporting surface of the base plate and rotatable with respect to said base plate about a first axis of rotation, the joint being substantially hollow; and a supporting tube operatively mounted onto the joint and rotatable with respect to said joint about a second axis of rotation;

wherein a range of rotation of the supporting tube with respect to the joint of the sanding device is delimited along at least one direction by at least one corresponding shoulder of the joint.

* * * * *